US006841327B2

(12) United States Patent
Otake et al.

(10) Patent No.: US 6,841,327 B2
(45) Date of Patent: Jan. 11, 2005

(54) DEVELOPING ASSEMBLY, IMAGE-FORMING APPARATUS AND PROCESS CARTRIDGE

(75) Inventors: Satoshi Otake, Shizuoka (JP); Yasuhide Goseki, Kanagawa (JP); Masayoshi Shimamura, Kanagawa (JP); Yasutaka Akashi, Kanagawa (JP); Kenji Fujishima, Kanagawa (JP); Kazunori Saiki, Kanagawa (JP); Naoki Okamoto, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 123 days.

(21) Appl. No.: 10/281,965

(22) Filed: Oct. 29, 2002

(65) Prior Publication Data

US 2003/0147674 A1 Aug. 7, 2003

(30) Foreign Application Priority Data

Oct. 30, 2001 (JP) ..... 2001-333441

(51) Int. Cl.[7] ..... G03G 9/08

(52) U.S. Cl. ..... 430/120; 430/111.1; 430/111.3; 430/111.4; 399/252; 399/258; 399/259

(58) Field of Search ..... 430/120, 111.1, 430/111.3, 111.4; 399/252, 258, 259

(56) References Cited

U.S. PATENT DOCUMENTS 4,989,044 A 1/1991 Nishimura et al. ..... 355/251

5,860,050 A 1/1999 Shimamura et al. ..... 399/276

FOREIGN PATENT DOCUMENTS

JP 1-277265 11/1989

*Primary Examiner*—Mark A. Chapman

(74) *Attorney, Agent, or Firm*—Fitzpatrick, Cella, Harper & Scinto

(57) ABSTRACT

In a developing assembly including a two-component developer container and a developer-carrying member, the developer-carrying member has at least a substrate and a resin coat layer formed on the substrate surface, and the resin-coat layer contains at least a binder resin and solid particles for making the resin-coat-layer surface uneven. The solid particles have an average circularity of 0.64 or more, which is the average value of the values calculated according to the equation $$\text{Circularity}=(4\times A)/\{(ML)^2\times\Pi\},$$

(wherein ML represents the Pythagorean-method maximum length of a particle projected image, and A represents the projected area of a particle image), and the resin-coat layer has a surface roughness fulfilling specific conditions attributable to the solid particles. Also disclosed are an image-forming apparatus and a process cartridge which employ the developing assembly.

20 Claims, 3 Drawing Sheets

DEVELOPING ASSEMBLY, IMAGE-FORMING APPARATUS AND PROCESS CARTRIDGE

BACKGROUND OF THE INVENTION

1. Field of the Invention

This invention relates to a developing assembly, an image-forming apparatus and a process cartridge which make use of a developer-carrying member used when an electrostatic latent image formed on a latent-image-bearing member, such as an electrophotographic photosensitive member or an electrostatic recording dielectric, is developed to render it visible in electrophotography.

2. Related Background Art

A number of methods are conventionally known as methods for electrophotography. Copies are commonly obtained by forming an electrostatic latent image on a photosensitive member by utilizing a photoconductive material and by various means, subsequently developing the latent image by the use of a toner to form a visible image (toner image), transferring the toner image to a transfer medium, such as paper, as the occasion, demands, and thereafter fixing the toner image to the transfer medium by heat, pressure or heat and pressure.

In general, methods of developing such electrostatic latent images by the use of toners, are roughly classified into a method in which a two-component developer comprised of a blend of a toner and a carrier is used and a method in which what is called a one-component developer is used to develop the latent image with a toner alone, without using any carrier.

Electrophotography has reached a level which can be satisfactorily used as document copying means for the time being. However, with the advancement of computers, high-definition display devices and so forth, higher image quality and higher grade reproduced full-color images, have been achieved by various methods, such as digital image processing and the application of alternating electric fields at the time of development. It is also sought in the future to achieve much higher image quality and much higher grade reproduced full-color images.

Among the methods of developing electrostatic latent images by the use of toners, the two-component developer, comprised of a blend of a toner and a carrier, is commonly preferably used in full-color copying machines or printers required to afford high image quality. In this developing system, the carrier provides the toner with positive or negative charge in a suitable quantity by triboelectric charging, and also carries the toner on the particle surfaces by the action of an electrostatic attraction force produced by the triboelectric charging.

The developer having a toner and a carrier is applied onto a developing sleeve internally provided with a magnet, in a stated layer thickness by the aid of a developer-layer thickness-control member, and is, by the use of magnetic force, transported to a developing zone formed between an electrostatic-image-bearing member (photosensitive member) and the developing sleeve. Across the photosensitive member and the developing sleeve, a certain development bias is kept applied, and the electrostatic latent image on the photosensitive member is developed with the toner at the developing zone.

Carriers included in such two-component developers are commonly roughly classified into a conductive carrier as typified by iron powder and what is called an insulating carrier comprised of magnetic particles such as iron powder, nickel powder or ferrite powder whose particle surfaces have been coated with an insulating resin. Where an alternating electric field is applied in order to achieve higher image quality, the carrier may lower the latent-image potential if it has a low electrical resistance to make it impossible to obtain good developed images. Hence, it is necessary for the carrier to have an electrical resistance at a certain level or higher. Where carrier cores are conductive, it is preferable to use a coated carrier. Also, preferably used as core materials are ferrite and magnetic-fine-particle-dispersed resin particles, having a high electrical resistance to a certain degree.

In general, the iron powder has so high a magnetic force as to make the developer form a hard magnetic brush in the developing zone where the toner in the developer develops the latent image. Hence, sweep marks may appear on the images or coarse images may appear to make it difficult to obtain developed images with high image quality. Accordingly, ferrite or a magnetic-fine-particle-dispersed resin carrier is preferably used also in order to make the carrier have a low magnetic force to achieve higher image quality.

In addition, in the case of the magnetic-fine-particle-dispersed resin carrier, it has a smaller specific gravity than the iron powder or ferrite. Hence, it not only can have a smaller intensity of magnetization per unit volume, but also may give less shear to the toner, and hence it can achieve not only high image quality, but also high developer durability. Thus, the magnetic-fine-particle-dispersed resin particles, having a high electrical resistance to a certain degree, are preferably used as the carrier.

As the developer-carrying member used in the conventional two-component developing system as mentioned above, for example, a metal, an alloy or a metallic compound is shaped or molded into a cylinder, and its surface is roughed by electrolysis, blasting, filing or the like to have a stated surface roughness to provide the developer-carrying member with surface unevenness. Such members having been treated for improving developer-transport performance are used. Of these, a sleeve made of aluminum is preferably used as the developer-carrying member in view of workability and low cost.

However, where the metal, alloy or metallic compound having a good workability is used, the sleeve tends to be deformed at the time of blasting to tend to cause uneven images. Moreover, where copies are made on many sheets, the hills that comprise the uneven sleeve surface may wear as a result of its rubbing with the developer when the developer is applied on the developing sleeve in a stated layer thickness by the aid of the developing-layer thickness-control member. At the same time, any fine powder and external additives of the toner may little by little come to adhere electrostatically and thermally to the sleeve surface, so that any contamination may begin to occur especially in the valleys of the uneven sleeve surface. Hence, the developing sleeve may come to have a materially smaller surface roughness, resulting in a lowering of the developer-transport performance.

In the case of a sleeve produced using a material comprised of stainless steel with superior wear resistance and provided with unevenness at its surface, too, the contamination of the sleeve surface due to the toner's fine powder and external additives as a result of many-sheet copying has not been able to be reduced to such an extent that the lowering of the developer-transport performance can be prevented in a satisfactory state. Because of the lowering of developer-transport performance due to such sleeve contamination, it has been difficult in the conventional developing sleeve to apply the developer stably onto the developing sleeve in a desired mass per unit area (hereinafter referred to as "M/S" which herein stands for mass on sleeve) However, the M/S, the quantity of developer on the developing sleeve, is closely connected to image quality by affecting density. Accordingly, it is important to attain the desired M/S stably over a long period of time, in order to long maintain a high-grade image quality.

In recent years, toners whose particle shape has been made substantially spherical have been brought forth for the purpose of further improving transfer performance and further improving image quality. Such toners, by virtue of their shape factors, have good releasability from photosensitive drums, so that a high transfer efficiency can be achieved. In particular, high-density large-area images can have a high grade. On the other hand, where two-component development is performed using such a toner, the coefficient of friction (between the sleeve and the developer may decrease because the particle shape of the toner is close to spherical. Thus, the conventional developing sleeve has an insufficient developer-transport performance. Moreover, in such a spherical toner, any external additives of the toner tend to be liberated, and hence any liberated external additives or any toner particles, in which the attached external additives are less, are liable to contaminate the sleeve surface. Thus, in the conventional developing sleeve, it has been more difficult to apply the developer in a stable M/S onto the developing sleeve.

With regard to the contamination of developing sleeve due to toner as stated above, the toner contamination and wear of the sleeve surface can be reduced to a certain extent when the magnetic-fine-particle-dispersed resin carrier is used, because the carrier can be made to have a low specific gravity and the carrier particles can be made spherical with ease to have less strain due to their carrier-particle shape, and hence the carrier may apply less load on the developer and the developer-carrying member when the developer layer thickness on the developing sleeve is controlled by means of the developer-layer thickness-control member. However, such contamination has not been reduced to such an extent that deterioration in the developer-transport performance can be prevented in a satisfactory state. Accordingly, it is sought to make further improvement.

As for the developer-carrying member, a method is disclosed in Japanese Patent Application Laid-open No. 01-277265 in which a rosin coat layer made of a triboelectrically chargeable resin having a conductive material or solid lubricant, such as carbon black or graphite dispersed therein, is formed on the developer-carrying member substrate in order to prevent any toner contamination that may be caused by electrostatic firm adhesion of the developer.

Where such a sleeve provided with the resin-coat layer having carbon black or graphite added thereto is used in a two-component developer developing assembly, the contamination of sleeve surface due to toner can be reduced. However, the resin coat layer on the developing sleeve has such insufficient wear resistance that the surface roughness tends to decrease because of the wear of the resin coat layer surface in many-sheet image reproduction. This makes it difficult to maintain the developer-transport performance stably on the developing sleeve.

SUMMARY OF THE INVENTION

An object of the present invention is to provide a developing assembly in which a two-component developer comprised of a magnetic carrier and a non-magnetic toner is used, and the developer-transport performance of the developer-carrying member is not easily changed even in image reproduction on many sheets and also the toner contamination may hardly occur; and an image-forming apparatus and a process cartridge which make use of such a developing assembly.

More specifically, an object of the present invention is to provide a developing assembly in which the developer on the developer-carrying member can have such stable and appropriate electric charges that high-grade images free of streaks or unevenness can be obtained without causing any decrease in image density and any ghost image even in repeated image reproduction; and an image-forming apparatus and a process cartridge which make use of such a developing assembly.

Another object of the present invention is to provide a developing assembly which ensures a superior wear resistance even when a good-workability and low-cost developer-carrying-member substrate is used, and can form stable images even in long-term running (extensive operation) in every environment; and an image-forming apparatus and a process cartridge which make use of such a developing assembly.

The above objects can be achieved by the present invention constructed as described below.

That is, the present invention provides a developing assembly comprising a developer container which holds therein a two-component developer comprised of a magnetic carrier and a non-magnetic toner, and a developer-carrying member by which the two-component developer held in the developer container is transported to a developing zone facing an electrostatic-latent-image-bearing member to render visible a latent image formed on the latent-image-bearing member, wherein the developer-carrying member has at least a substrate and a resin-coat layer formed on the substrate surface; and the resin-coat layer contains at least a binder resin and solid particles for forming an uneven resin-coat-layer surface;

the solid particles have an average circularity of 0.64 or more, which is the average value of the values calculated according to the following equation (1):

$$\text{Circularity}=(4\times A)/\{(ML)^2\times\Pi\} \quad (1),$$

for each solid particle, wherein ML represents the Pythagorean-method maximum length of a particle projected image of one of the solid particles, and A represents the projected area of a particle image of one of the solid particles; and the resin-coat layer satisfies the following condition:

$$S\geqq 3.0$$

where, in the surface profile of the resin-coat layer, measured using a laser of a confocal optical system, an average value of the heights from the bottoms of valleys to the vertexes of hills of the uneven resin-coat-layer surface in the whole measurement region is regarded as the standard height, and the proportion of the surface area occupied by the parts of hills more than 0.1×r (r: weight-average particle diameter (μm) of the magnetic carrier used) higher than the standard height is represented by S (%); and further fulfilling the following conditions:

$$Rp/Rv\geqq 1.2,\ Rz/Rv\geqq 2.0 \text{ and } r/Rp\leqq 6.0$$

where the ten-point average roughness of the resin-coat-layer surface is represented by Rz ($\mu$m), the average-line depth of the resin-coat-surfave layer is represented by Rp ($\mu$m), and the average-line height of the resin-coat-surface layer is represented by Rv ($\mu$m).

The present invention also provides an image-forming apparatus having at least (i) an electrostatic-latent-image-bearing member configured and positioned to hold thereon an electrostatic latent image and (ii) a developing assembly configured and positioned to develop the electrostatic latent image with a developer at a developing zone to form a developed image, the developing assembly is such a developing assembly constructed as described above.

The present invention still also provides the above image-forming apparatus, wherein the electrostatic-latent-image-bearing member is an electrophotographic photosensitive member; the above image-forming apparatus, which further has a transfer means for transferring the developed image to a recording medium; and the above image-forming apparatus, which further has a fixing means for fixing the developed image onto the recording medium.

The present invention further provides a process cartridge which is detachably mountable on the main body of an image-forming apparatus, which process cartridge integrally holds at least a developing assembly for developing an electrostatic latent image with a developer at a developing zone to form a developed image, and the developing assembly is such a developing assembly constructed as described above.

DETAILED DESCRIPTION OF THE PREFERRED EMBODIMENTS

Figure 1:
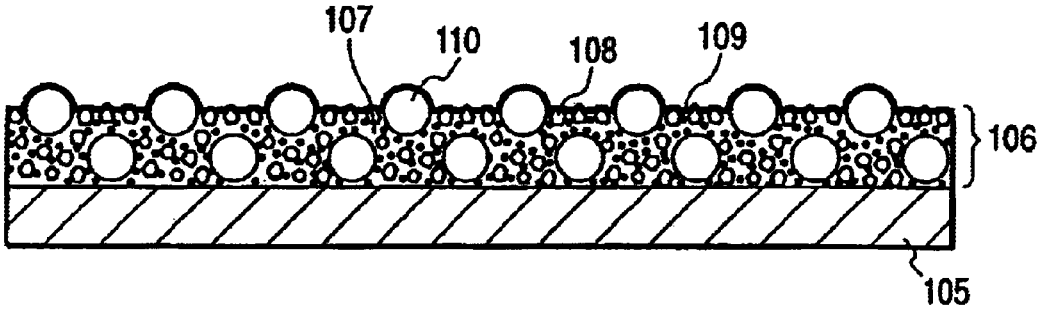
FIG. 1 is a diagrammatic view showing an example of the construction of a developing-sleeve surface layer in the present invention.

As a result of extensive studies on the problems discussed previously, the present inventors have discovered that, in a developing assembly making use of a two-component developer comprised of a magnetic carrier and a non-magnetic toner, the resin-coat layer of the developer-carrying member surface may be so constructed that solid particles for providing the surface with unevenness are dispersed in its binder resin and also the above conditions are fulfilled, and this brings about the effect of making the developer-transport performance of the developer-carrying member remarkably stabler than any conventional developing assemblies.

The present invention is described below in detail by giving preferred embodiments. First, the solid particles used in the resin coat layer applied onto the surface of a substrate of the developer-carrying member in the present invention are described.

Solid particles having a certain particle diameter are incorporated in the resin-coat layer formed by coating at the developer-carrying member surface, whereby the resin-coat-layer surface can have uniform unevenness (hills and valleys) formed and retained for the carrier, and carrier particles having a larger particle diameter than the size of the hills and valleys can stably be transported.

In the present invention, where the resin-coat layer is made to have conductivity, carbon black or graphite particles, made to serve also as a solid lubricant, are added in some cases. The addition of such particles can form fine unevenness at the initial stage. However, the particles may be influenced by a magnetic material and external additives, such as an abrasive, which are contained in the carrier or toner, to tend to be scraped off or fall out. Thus, it is impossible to maintain such surface unevenness during the course of extensive operation. In the present invention, the surface profile must be maintained even during the course of extensive operation, and hence the solid particles to be added must be resistant to such scraping.

The above construction according to the present invention can make the change in the shape of the surface unevenness small because particles are exposed to appear one after another from the interior of the resin coat layer even when influenced by a magnetic material and external additives, such as an abrasive, which are contained in the carrier or toner, and also subjected to a force from the developer-layer thickness-control member and so forth, until the coated resin component, and so forth, become scraped off, or even when the particles themselves fall out under such influence.

As the solid particles used in the present invention, commonly known particles may be used. For example, usable are commonly known resin particles of vinyl polymers or copolymers such as polymethyl methacrylate, polyethyl acrylate, polybutadiene, polyethylene, polypropylene and polystyrene, and of benzoguanamine resin, phenol resin, polyamide resin, fluorine resin, silicone resin, epoxy resin and polyester resin; carbon particles; metal particles; particles of metal oxides such as cerium oxide, chromium oxide, aluminum oxide, silicon oxide, zirconium oxide and titanium oxide; and other inorganic particles of nitrides such as boron nitride, aluminum nitride and titanium nitride, carbides such as silicon carbide, titanium carbide, boron carbide, tungsten carbide, vanadium carbide and zirconium carbide, and borides such as zirconium boride, titanium boride, silicon boride and tungsten boride, as well as silica and alumina. These particles for making the surface roughness stable may be added in an amount of from 1 to 100 parts by weight based on 100 parts by weight of the binder resin.

The solid particles used in the present invention may preferably have an average circularity of 0.64 or more, which is determined according to the following equation (1). Those having an average circularity of less than 0.64 are undesirable from the viewpoint of rapid and uniform charging of the toner and wear resistance and strength of the resin-coat layer, because the solid particles may poorly be dispersed in the resin-coat layer and also may make it difficult to provide the resin-coat layer with unevenness, tending to make the resin-coat layer have non-uniform surface roughness.

In the present invention, the average circularity of the solid particles refers to the average value of the values calculated according to the following equation (1):

$$\text{Circularity}=(4\times A)/\{(ML)^2\times\Pi\} \quad (1),$$

for each solid particle, wherein ML represents the Pythagorean-method maximum length of a particle projected image of one of the solid particles, and A represents the projected area of a particle image of one of the solid particles.

In the present invention, as a specific method for determining the above average circularity, a solid-particle projected image magnified by an optical system is inputted to an image analyzer, and the values of circularity of individual particles are calculated. The values obtained are averaged to find the average circularity.

In the present invention, measurement of the circularity is limited to particles of the circularity-equivalent diameter of 2 $\mu$m or more, which can ensure reliability as the average value and has a great influence on the characteristics of the resin coat layer. Also, in order to ensure the reliability of these values, the circularity is measured on at least 3,000 particles, and preferably at least 5,000 particles, as the number of particles to be measured.

As a specific measuring instrument which can efficiently analyze the circularity of such a large number of solid particles, a multi-image analyzer is used (trade name: Multisizer; manufactured by Beckmann-Coulter Co.).

The multi-image analyzer is an electrical-resistance system particle-size-distribution measuring instrument combined with the function to photograph particle images with a CCD (charge-coupled device) camera and the function to make image analysis of the particle images photographed. Stated in detail, particles dispersed uniformly in an electrolytic solution by ultrasonic dispersion or the like are detected by a change in electrical resistance, which is caused when the particles pass through an aperture of the Multisizer, the electrical-resistance system particle-size-distribution measuring instrument. In synchronization therewith, a strobe is actuated to emit light and the particle images are photographed with a CCD camera. Data on the particle images are inputted to a personal computer, and are binary coded, followed by image analysis.

As the solid particles used in the present invention, spherical particles may preferably be used, and known spherical particles may be used. They may include, e.g., spherical resin particles, spherical metal oxide particles and spherical carbide particles. As the spherical resin particles, spherical particles produced by, e.g., dispersion polymerization such as suspension polymerization may preferably be used.

The spherical resin particles may be added in a smaller quantity to achieve a preferable surface roughness and to provide a more uniform surface profile with ease. Such spherical resin particles may include resin particles of acrylates, such as polyacrylates and polymethacrylates, resin particles of polyamides, such as nylon, resin particles of polyolefins, such as polyethylene and polypropylene, and silicone resin particles, phenol resin particles, polyurethane resin particles, styrene resin particles and benzoguanamine resin particles. Resin particles obtained by pulverization may also be used after they have been subjected to thermal or physical treatment to make them spherical.

FIG. 1 is a diagrammatic view of an example of a cross section showing how solid particles 110 for forming the unevenness on a substrate 105 are dispersed in a binder resin 107 to form a surface-resin-coat layer 106. Reference numeral 109 denotes conductive fine powder added in order to provide the resin-coat-layer with conductivity, which, here, does not contribute to any substantial formation of the unevenness. The solid particles denoted by 110 provide the resin-coat-layer surface with relatively large unevenness. Reference numeral 108 denotes different solid particles, showing an example in which they provide the resin-coat layer with minute unevenness and at the same time have the function to provide triboelectric charges. Especially where the solid particles are used in such a manner, conductive particles may particularly preferably be used among the solid particles for forming these relatively large unevenness and minute unevenness.

The reason is presumed to be that by making the particles have conductivity, it is hard for electric charges to accumulate on the particle surfaces by virtue of the conductivity and toner adhesion Can be reduced and the performance of imparting charges to toner is improved.

In the present invention, as conductivity of the solid particles, they may preferably be particles having a volume resistivity of $10^6$ Ω·cm or less, and preferably from $10^3$ Ω·cm cm to $10^6$ Ω·cm. If such particles have a volume resistivity of more than $10^6$ Ω·cm, they tend to cause contamination or melt-adhesion of toner around spherical particles exposed out of the resin coat layer surface as a result of wear, and also it may become difficult to perform rapid and uniform charging.

The solid particles may also preferably have a true density of about 3,000 kg/m$^3$ or less.

Solid particles having a too high true density, even though they are conductive, are undesirable because they must be added in a larger quantity in order to form the same surface roughness and also they differ greatly in true density from that of the resin or resin composition and hence the particles tend to be dispersed in a non-uniform state at the time of their production, so that they may be dispersed in a non-uniform state also in the resin-coat layer having been formed.

The solid particles which are spherical are also more preferable because the contact area with the developer-layer thickness-control member brought into pressure contact with the developing sleeve is lessened and hence the rotational torque that may increase because of a frictional force and the adhesion of toner can be reduced. Better results are obtainable especially when conductive spherical particles as described below are used.

More specifically, as a method for obtaining particularly preferable conductive spherical particles used in the present invention, it may include, e.g., a method in which spherical resin particles or mesocarbon microbeads are fired and thereby carbonized and/or graphitized to obtain spherical carbon particles having a low density and a good conductivity. The resin used in the spherical resin particles may include, e.g., phenol resins, naphthalene resins, furan resins, xylene resins, divinylbenzene polymers, styrene-divinylbenzene copolymers, and polyacrylonitrile. Also, the mesocarbon microbeads may usually be produced by subjecting spherical crystals formed in the course of heating and firing a mesopitch to washing with a large quantity of solvent such as tar, middle oil or quinoline.

As a method for obtaining more preferable conductive spherical particles, it may include a method in which a bulk-mesophase pitch is applied onto the surfaces of spherical resin particles such as phenol resin, naphthalene resin, furan resin, xylene resin, divinylbenzene polymer, styrene-divinylbenzene copolymer or polyacrylonitrile particles by a mechanochemical method, and the resulting particles are heated in an oxidative atmosphere or in vacuo, followed by firing in an inert atmosphere or in vacuo so as to be carbonized and/or graphitized to produce conductive spherical carbon particles. Spherical carbon particles obtained by this method are more preferred because the spherical carbon particles obtained when converted into graphite particles can be better crystallized at their applied portions to bring about an improvement in conductivity.

When the conductive spherical carbon particles are obtained by any one of the above methods, the conductivity of the resulting spherical carbon particles can be controlled by changing conditions for firing, and such particles are preferably used in the present invention. In order to further improve the conductivity, the spherical carbon particles obtained by the above methods may optionally be coated with conductive metal and/or metal oxide to such an extent that the true density of the conductive spherical particles is not too high.

The solid particles may preferably have a number-average particle diameter of from 2 μm to 50 μm. Solid particles having a number-average particle diameter of less than 2 μm are undesirable because such particles may be less effective in the formation of uniform unevenness on the resin-coat layer to tend to cause a lowering of developer-transport performance as a result of wear of the resin-coat layer. Those having a number-average particle diameter of more than 50 μm may make the resin-coat-layer surface have excessively large unevenness so that the developer may insufficiently be controlled and non-uniformly be transported to tend to cause streaks, uneven density, and so forth in images. Also, the developer may undergo so strong a frictional force as to tend to cause a deterioration of the developer at the time of extensive operation and the contamination of the resin-coat-layer surface by toner, resulting in a lowering of mechanical strength of the resin-coat layer. Thus, such particles are undesirable.

The particle diameters of the solid particles are measured with a Coulter Model LS-130 particle size distribution meter (manufactured by Beckmann-Coulter Co.), which is a laser-diffraction-particle-size-distribution meter. In the measuring method, an aqueous module is used. As a measuring solvent, pure water is used. The inside of a measuring system of the particle-size-distribution meter is washed with pure water for about 5 minutes, and 10 to 25 mg of sodium sulfite as an anti-foaming agent is added in the measuring system to carry out a background function. Next, three or four drops of a surface active agent are added in 10 ml of pure water, and 5 to 25 mg of a measurement sample is further added. The aqueous solution in which the sample has been suspended is subjected to dispersion by means of an ultrasonic dispersion machine for about 1 to 3 minutes to obtain a sample fluid. The sample fluid is added little by little in the measuring system of the above measuring device, and the sample concentration in the measuring system is adjusted so as to be 45 to 55% as PIDS on the screen of the device and measurement is made. Then, the number-average particle diameter calculated from number distribution is determined.

The unevenness profile of the resin-coat-layer surface is measured with an ultra-depth profile analyzer microscope VK-8500 (manufactured by Keyence Co.). This instrument is one in which laser light emitted from a light source is applied to a measurement object and laser light reflecting from the measurement object is received by a receptor (light-receiving device) at the confocal position, where the profile of the object is measured according to the information on the objective lens position at which the maximum amount of light is received.

Measuring conditions are so set that the objective lens has 50 magnifications, the measurement range is 295 μm in the transverse direction×221 μm in the longitudinal direction and the extent of lens movement in the height direction is 0.1 μm. The measurement results are analyzed using an image analysis software VK-H1W (manufactured by Keyence Co.). The heights from the bottoms of valleys to the vertexes of hills of the uneven (hills and valleys) resin-coat-layer surface in the whole measurement region are averaged to calculate the standard height of the hills and valleys at the measured part, and the proportion of the surface area occupied by parts of hills more than 0.1×r (r: weight-average particle diameter (μm) of the carrier used) higher than the standard height is represented by S (%).

That is, the occupied-area proportion S is expressed by S1/S2×100(%) where S1 is the surface area of parts of hills that are cut by a plane which is parallel to, and at the height of the carrier-particle diameter r×0.1 (μm) from the standard plane, and S2 is the surface area of the measured region. In the present invention, it is preferable to satisfy S≧3.0, and more preferable to satisfy S≧5.0. If the value of S is less than 3.0%, the hills can not have a height large enough for the developer to be transported, so that transport stability can not be maintained to cause problems of, e.g., a decrease in image density.

The surface-roughness parameters Rz, Rp and Xv (Rz: ten-point average roughness (μm); Rp: average-line depth (μm); Rv: average-line height (μm)) of the resin coat layer surface are determined by making a measurement with SURFCOATER SE-3500 (trade name), manufactured by Kosaka Laboratory Ltd, on 5 spots in the axial direction×4 spots in the peripherals direction=20 spots under the conditions of a feed speed of 0.5 mm/sec., a measurement length of 8.0 mm, a roughness cut-off λc of 0.8 and auto-leveling/ON, and averaging the resulting values. Here, the average-line height Rv is the value found in a way that the profile curve is cut off at intervals of the standard length, the maximum length from the average line to the highest vertex in each standard length is measured, and the measured maximum values are averaged. The average-line depth Rp is also the value found in a way that the maximum depth from the average line to the deepest valley in each standard length is measured, and the measured maximum depths are averaged. The ten-point average roughness Rz is the value found according to JIS B0601.

In the present invention, it is preferable to satisfy Rp/Rv≧1.2, Rz/Rv≧2.0 and r/Rp≦6.0. If the value of Rp/Rv is less than 1.2, the value of Rz/Rv is less than 2.0 and the value of r/Rp is more than 6.0, sufficient developer-transport performance may be unachievable to make transport stability not maintainable in long-term image reproduction. Also, the load caused by contact with the carrier or the toner may increase to cause toner contamination, resin coat layer scraping and so forth, bringing about problems of, e.g., a decrease in image density.

In the resin coat layer formed at the surface of the developer-carrying member of the present invention, lubricating particles (lubricating fine powder) may further be used in combination and dispersed. Such lubricating particles may include, e.g., particles of graphite, molybdenum disulfide, boron nitride, mica, graphite fluoride, silver-niobium selenide, calcium chloride-graphite, talc, and fatty acid metal salts such as zinc stearate.

As the lubricating particles, those having a number-average particle diameter of preferably from 0.2 to 20 μm, and more preferably from 1 to 15 μm, may be used. Lubricating particles having a number average particle diameter of less than 0.2 μm are not desirable because it is difficult to attain sufficient lubricating properties. Those having a number average particle diameter of more than 20 μm are not desirable in view of wear resistance of the resin coat layer. The particle diameter of such lubricating particles is measured with the laser-diffraction particle-size-distribution meter, a Coulter Model. LS-130 particle-size-distribution meter (manufactured by Beckmann-Coulter Co.) as in the case of the solid particles.

In the coating fluid for forming the resin-coat layer, a charge-control agent (a charge-control material) may further be added in order to control the charge-providing ability of the resin-coat layer to the toner. The charge-control agent may include, e.g., Nigrosine, and products modified with a fatty-acid metal salt; quaternary ammonium salts, such as tributylbenzylammonium 1-hydroxy-4-naphthosulfonate and tetrabutylammonium teterafluoroborate, and analogues of these, including onium salts, such as phosphonium salts and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin berates such as dibutyltin borate, dioctyltin borate and dicyclohexyltin borate; as well as guanidines and imidazole compounds.

As the binder resin materials for the resin-coat-layer of the developer-carrying member in the present invention, commonly known resins may be used. For example, usable are thermoplastic resins such as styrene resins, vinyl resins, polyether sulfone resin, polycarbonate resin, polyphenylene oxide resin, polyamide resins, fluorine resins, cellulose resins and acrylic resins; and heat- or photocurable resins such as epoxy resins, polyester resins, alkyd resins, phenol resins, melamine resins, polyurethane resins, urea resins, silicone resins and polyimide resins. In particular, more preferred are those having release properties, such as silicone resins and fluorine resins, and those having good mechanical properties, such as polyether sulfone, polycarbonate, polyphenylene oxide, polyamide, phenol, polyester, polyurethane, styrene resins and acrylic resins.

In the present invention, the resin-coat layer of the developer-carrying member may preferably have a volume resistivity of $10^3$ Ω·cm or below, and more preferably from $10^4$ to $10^2$ Ω·cm. If the resin-coat layer has a volume resistivity higher than $10^4$ Ω·cm, the charge-up of toner is liable to occur, tending to cause toner contamination on the resin-coat layer. The volume resistivity of the resin-coat layer is measured on a PET sheet of 100 μm in thickness on which a coat layer of 7 to 20 μm in thickness is formed, using LORESTA AP (trade name; manufactured by Mitsubishi Petrochemical Engineering Co., Ltd.) fitted with a four-terminal probe.

In the present invention, in order to control the volume resistivity of the resin-coat layer, additional conductive fine particles may be dispersed and incorporated in the resin-coat layer, which are used in combination with the solid particles described above. Such additional conductive fine particles may preferably be those having a number-average particle diameter of 1 μm or less, and more preferably from 0.01 to 0.8 μm. If the additional conductive fine particles dispersed and incorporated into the resin-coat layer, which are used in combination with the solid particles, have a number-average particle diameter of more than 1 μm, it may be difficult to control the volume resistivity of the resin-coat layer to be low, tending to cause toner contamination due to the charge-up phenomenon of toner.

The additional conductive fine particles usable in the present invention may include, e.g., carbon black such as furnace black, lamp black, thermal black, acetylene black and channel black; particles of metal oxides such as titanium oxide, tin oxide, zinc oxide, molybdenum oxide, potassium titanate, antimony oxide and indium oxide; particles of metals such as aluminum, copper, silver and nickel; and particles of inorganic fillers such as graphite, metal fibers and carbon fibers.

The particle diameter of the conductive fine particles is measured in the following way: Using an electron microscope, the particle diameter of the conductive fine particles is measured. A photograph is taken at a magnification of 60,000. If it is difficult to do so, a photograph taken at a lower magnification is enlarged so as to be a magnification of 60,000. On the photograph, particle diameters of primary particles are measured. Here, lengths and breadths are measured, and a value found by averaging the measurements is regarded as the particle diameter. This is measured on 100 samples, and a 50% value of the measurements is regarded as the average particle diameter.

The developer-carrying member used in the present invention is described below. The developer-carrying member used in the present invention is chiefly constituted of a substrate metal cylinder and a resin layer formed around it by coating (the resin-coat layer). As the metal cylinder, stainless steel and aluminum may preferably chiefly be used.

The proportion of components constituting the resin-coat layer is described below, which shows particularly preferable ranges in the present invention. The resin-coat layer may preferably comprise from 2 to 120 parts by weight of solid particles dispersed therein based on 100 parts by weight of the coating resin, and more preferably from 2 to 80 parts by weight, with the latter range giving particularly preferable results. If the resin-coat layer contains less than 2 parts by weight of solid particles, the effect attributable to the addition of the solid particles may be so small as to make it difficult for the necessary hills to be formed. If the resin-coat layer contains more than 120 parts by weight of solid particles, the adhesion of the solid particles to the surface-resin-coat layer may be so weakened as to lower wear resistance.

In the case when the lubricating particles are used in combination and incorporated in the resin-coat layer, the resin-coat layer may preferably contain from 5 to 120 parts by weight of lubricating particles based on 100 parts by weight of the coating resin, and more preferably from 10 to 100 parts by weight, with the latter range giving particularly preferable results. If the resin-coat layer contains more than 120 parts by weight of lubricating particles, a lowering of film strength may be seen. If the lubricating particles comprise less than 5 parts by weight of the resin-coat layer, toner contamination tends to easily occur on the resin-coat-layer surface when, e.g., used for a long term.

When the conductive fine particles are dispersed and incorporated in combination in the resin-coat layer as described previously, the resin-coat layer may be preferably contain 40 parts by weight or less of conductive fine particles based on 100 parts by weight of the coating resin, and more preferably from 2 to 35 parts by weight, with the latter range giving particularly preferable results. More specifically, if the conductive fine particles comprise more than 40 parts by weight of the resin-coat layer, a lowering of film strength may be seen undesirably.

When the charge-control agent is incorporated in combination in the resin-coat layer, the resin-coat layer agent may preferably contain from 1 to 100 parts by weight of the charge-control agent based on 100 parts by weight of the coating resin. If the charge-control agent comprises less than 1 part by weight of the resin-coat layer, no effect on charge controllability attributable to the addition may be seen. If the charge-control agent comprises more than 100 parts by weight, dispersibility into the coating resin deteriorates and film strength tends to be lowered.

For dispersing these components, commonly known dispersion machines, e.g., dispersion machines making use of beads, such as a paint shaker, a sand mill, an attritor, a Daino mill and a pearl mill may preferably be used. As a method of forming the resin-coat layer on the developer-carrying member, the following may be used: A conductive support is set upright in parallel to the movement direction of a spray gun and the conductive support is rotated, during which a coating material, in which the above materials have been dispersed, is applied onto the conductive support by air spraying, while the spray gun is moved upward at a constant rate, keeping constant the distance between the conductive support surface and a nozzle tip of the spray gun.

In the air spraying, the coating materials are commonly made into fine-particle droplets in a stable form so that a coating layer with good dispersion can be obtained. This coating may be dried at 150° C. for 30 minutes by means of a high-temperature dryer to effect curing to obtain the developer-carrying member having the resin coat layer on its surface.

The resin-coat layer constituted as described above may preferably have a layer thickness of 25 μm or less, more preferably 20 μm or less, and still more preferably from 4 μm to 20 μm. Such a thickness is preferable for obtaining a uniform layer thickness. The thickness is not particularly limited thereto. The layer thickness depends on the external diameter of the substrate and the materials used in the resin-coat layer, and can be attained when formed in a coverage (coating weight) of about 4,000 to 20,000 mg/m$^2$.

The carrier is described below. The carrier used in the developing assembly of the present invention may include, e.g., particles of metals such as surface-oxidized or unoxidized iron, nickel, copper, zinc, cobalt, manganese, chromium and rare earth elements, and alloys or oxides thereof, and ferrite, any of which may be used. There are no particular limitations on methods for the production.

For the purpose of charge control and so forth, it is also preferable to further coat the surfaces of the carrier particles with a coat material having a resin. As methods therefor, any conventionally known methods may be used, e.g., a method in which the coat material having a resin is dissolved or suspended in a solvent and applied to carrier particles, or a method in which the coat material is blended merely in the form of powder. In order to make coat layers stable, preferred is the method in which the coat material is dissolved in a solvent and applied.

The coat material to be applied onto the carrier-particle surfaces may differ depending on the materials for toners. It may include, but is not limited to, aninoacrylate resins, acrylic resins, copolymers of any of these resins with styrene resins; and silicone resins, polyester resins, fluorine resins, polytetrafluoroethylene, monochlorotrifluoroethylene polymers and polyvinylidene fluoride; any of which may preferably be used. The coating weight of any of these compounds may appropriately be determined so as to satisfy the required charge-providing performance of the carrier, and may commonly be in the range of from 0.1 to 30% by weight, and preferably from 0.3 to 20% by weight, in total, based on the weight of the carrier.

Materials for the carrier used in the developing assembly of the present invention may be a magnetic-fine-particle-dispersed resin carrier obtained by dispersing magnetic fine particles in a binder resin. Such a carrier can readily be controlled to have a low specific gravity and a low magnetization, may apply less load on the developer and the developer-carrying member surface, can stably maintain the transport quantity on the developer-carrying member, and hence may more preferably be used.

As the binder resin used in the core material for constituting the magnetic-fine-particle-dispersed resin carrier used in the present invention, it may include all resins obtained by polymerizing vinyl monomers. The vinyl monomers herein referred to may include, e.g., styrene; styrene derivatives such as o-methylstyrene, m-methylstyrene, p-methylstyrene, p-phenylstyrene, p-ethylstyrene, 2,4-dimethylstyrene, p-n-butylstyrene, p-tert-butylstyrene, p-n-bexylstyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene and unsaturated monoolefins such as ethylene, propylene, butylene and isobutylene; unsaturated diolefines such as butadiene and isoprene; vinyl halides such as vinyl chloride, vinylidene chloride, vinyl brominde and vinyl fluoride; vinyl esters such as vinyl acetate, vinyl propionate and vinyl benzoate; methacrylic acid, and (-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate and phenyl methacrylate; acrylic acid, and acrylates such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate and phenyl acrylate; maleic acid, and maleic acid half esters; vinyl ethers such as mothyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; acrylic acid or methacrylic acid derivatives such as acrylonitrile, methacrylonitrile and acrylamide; and acroleins. Those obtained by polymerizing at least one of these may be used.

In addition to the resins obtained by polymerizing vinyl monomers, also usable are non-vinyl condensation resins such as phenolic resins, urea resins, polyurethane resins, polyimide resins, cellulose resins and polyether resins, or mixtures of any of these and the above vinyl resins.

The magnetic fine particles of the magnetic-fine-particle-dispersed resin carrier used in the present invention may include, e.g., particles of ferromagnetic metals such as iron, cobalt and nickel; and particles of alloys or compounds containing elements exhibiting ferromagnetism such as iron, cobalt and nickel, as exemplified by ferrite, magnetite and hematite.

The magnetic fine particles may also preferably have a primary average particle diameter of 2.0 μm or less. If it is larger than 2.0 μm, the core material can not have a dense surface, and any uniform coating can not be performed. Still also, the magnetic fine particles in the present invention must have a resistivity of $10^9$ Ω·cm or less, and comprise 30% by weight or more, and preferably 50% by weight or more of the carrier, based on the total weight of the carrier. If the magnetic fine particles are less than 30% by weight of the carrier, adhesion to the photosensitive member may occur and it is difficult to control the resistance of the carrier.

To measure the number-average particle diameter of the magnetic fine particles, using a photographic image magnified to 5,000 to 20,000 times with a transmission electron microscope whose trade name is H-800, manufactured by Hitachi Ltd., at least 300 particles of 0.01 μm or more in particle diameter are picked up at random and their horizontal-direction Feret's diameters are measured as fine-particle diameters with an image processing analyzer whose trade name is LUZEX-3, manufactured by Nireko Co., followed by averaging processing to calculate the number-average particle diameter.

To measure the resistivity (specific resistance), a cell is filled with fine particles, and upper and lower electrodes are so disposed as to come into contact with the fine particles filled thereinto as a sample. A voltage is applied across the electrodes, and the electric current flowing there is measured to determine the resistivity. When the cell is filed with the fine particles the filling occurs while rotating the upper electrode right and left so as to come into uniform contact with the sample. In this measuring method, the resistivity is measured under conditions of a contact area S of about 2.3 $cm^2$ between the fine particles filled and the electrodes, a thickness d of about 2 mm, a load of 180 g for the upper electrode, and an applied voltage of 100 V.

As the carrier, it may have a weight-average particle diameter of from 15 μm to 60 μm, preferably from 20 μm to 60 μm, and more preferably from 20 μm to 45 μm. If the carrier has a weight-average particle diameter of less than 15 μm, the carrier tends to adhere to the photosensitive member to produce scratches or the like in the photosensitive member, which may cause image detrioration. If, on the other hand, it has a weight-average particle diameter of more than 60 μm, the uniformity of solid images and the reproducibility of minute dots tend to decrease. Also, a great shear may be applied to the developer-carrying member and developer in the developing assembly to cause wear of the surface-resin-coat layer of the developer-carrying member, toner contamination, developer deterioration, and so forth.

To measure the particle diameter of the carrier, at least 300 particles of 0.01 μm or more in particle diameter are picked up at random and measurement is made in the same tanner as in the number-average particle diameter of the magnetic fine particles, using the image processing analyzer having the trade name LUZEX-3, manufactured by Nireko Co.

The carrier in the present invention may preferably have a true specific gravity within the range of from 1.5 to 5.0, and more preferably from 1.5 to 4.5. One having a true specific gravity of more than 5.0 is undesirable because it may cause wear of the surface-resin-coat layer of the developer-carrying member, toner contamination, developer deterioration, and so forth. One having a true specific gravity of less than 5.0 makes it practically impossible to obtain a magnetic force strong enough to keep the carrier from adhering to the photosensitive member.

The carrier used in the present invention may suitably have a resistivity (specific resistance) within the range of from $10^7$ to $10^{15}$ Ω·cm. If it has a resistivity of less than $10^7$ Ω·cm, electric current may leak from the developer-carrying member to the photosensitive member at the developing zone in a developing system where a bias voltage is applied, so that any good images are not obtainable. If, on the other hand, it has a resistivity of more than $10^{15}$ Ω·cm, it may cause the phenomenon of charge-up in the condition of low humidity to bring about image deterioration, such as, density decrease, faulty transfer, fog, and so forth.

The carrier in the present invention may preferably have a sphericity (length/breadth) of 2 or less. If it has a sphericity of more than 2, the effect of lessening the shear applied to the developer-carrying member surface and the developer and the effect of improving fluidity as the developer tend to decrease.

As a means for achieving a sphericity of 2 or less in the magnetic-fine-particle-dispersed resin carrier used in the present invention, there may be used a method in which the core material is heated to fuse particle surfaces to be spherical, or a method in which particles are mechanically made spherical. Besides, as a method of forming the core material, a usual suspension polymerization process may be used in which the magnetic fine particles, a polymerization initiator, a suspension stabilizer, and so forth, are added and dispersed in the monomer solution of the binder resin used in the core material, followed by granulation polymerization to obtain the core material. The use of such methods enables a sphericity of 2 or less of the carrier to be achieved without subjecting the core material to the above heat or mechanical treatment.

The carrier described above and the toner particles may be blended in a proportion of, as toner concentration in the two-component developer, from 2 to 9% by weight, and preferably from 3 to 8% by weight, where good results are obtainable. If the toner concentration is less than 2% by weight, the image density may be too low to be tolerable in practical use. If it is more than 9% by weight, fog and in-machine scatter of the developer may greatly occur, and the developer may have a short lifetime.

In the toner used in the present invention, either of toner particles produced by pulverization and those by polymerization may be used. Toner particles produced by polymerization, in particular, suspension polymerization, may preferably be used. Seed polymerization, in which a monomer is further adsorbed on polymer particles obtained previously and thereafter a polymerization initiator is added to carry out polymerization, may also preferably be used in the present invention.

In the production of toner particles by pulverization, constituent materials such as a binder resin, a colorant, and a charge control agent are thoroughly mixed by means of a ball mill or any other mixer, and thereafter the mixture obtained is well melt-kneaded using a heat-kneading machine, such as a heat-roll kneader or an extruder. The kneaded product obtained is cooled to solidify, followed by mechanical pulverization and then classification to obtain the toner particles. Also, after the classification, the toner particles may preferably be made spherical by heat treatment or by applying a mechanical impact thereto.

Figure 2:
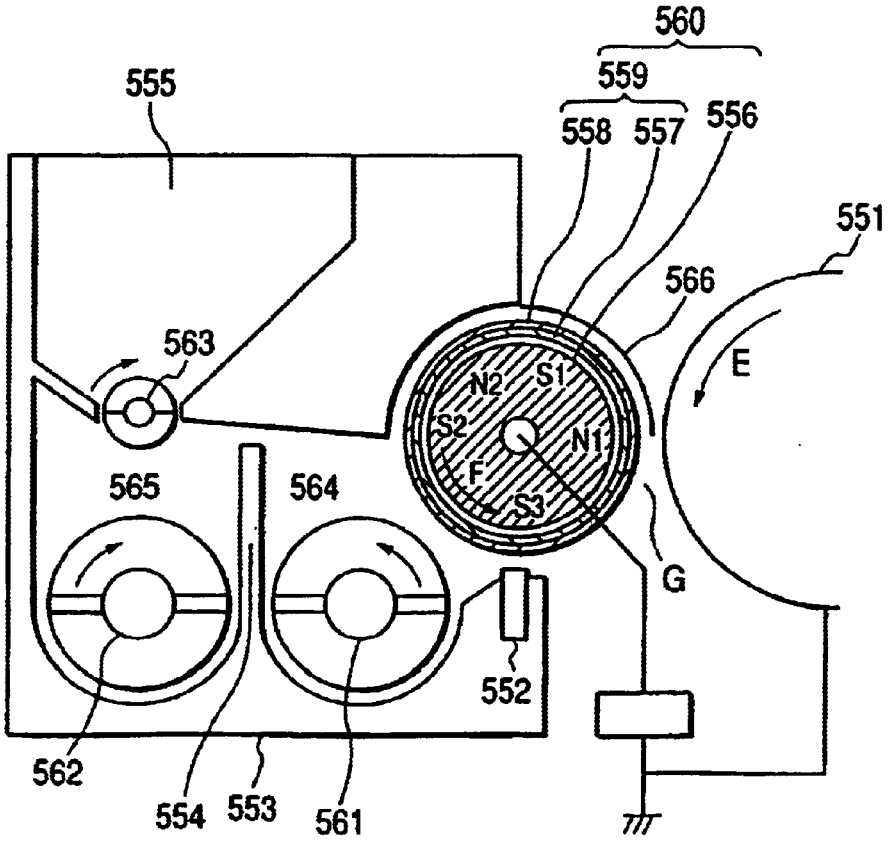
FIG. 2 is a schematic view showing an example of the developing assembly of the present invention.

An example of a two-component developer developing assembly according to the present invention is described below. FIG. 2 is a diagrammatic view of a developing assembly suited for using a two-component developer. As shown in FIG. 2, the developing assembly has as the developer-carrying member a non-magnetic developing sleeve 559, substantially half of which is received in a developer chamber 564 of a developer container 553 and faces an electrostatic-latent-image-bearing member 551 rotated in the direction of an arrow E. In the present invention, a resin coat layer 558 is provided on the surface of a cylindrical non-magnetic metal substrate 557. Inside this developing sleeve 559, a magnet roller 556, functioning as a magnetic-field generation means is stationarily provided, and these form a developing roller 560.

The magnet roller 556 is a magnet formed of a five-pole construction whose poles are denoted by S1, S2, S3, N1 and N2. A two-component developer comprised of a blond of a toner and a magnetic carrier is held in the developer chamber 564. This developer is sent into an agitation chamber 565 of the developer container 553 through an opening in a partition wall 554 set open at its upper end in the developer chamber 564, where a toner having been fed into a toner chamber 555 is supplied therefrom into the agitation chamber 565 via a toner-feed-control member 563 and is blended with the developer by a first developer agitation and transport member 562 provided in the agitation chamber 565. The developer having been agitated in the agitation chamber 565 is returned into the developer chamber 564 through another opening (not shown) in the partition wall 554, where it is agitated and transported by a second developer agitation and transport member 561, during which it is transported to the developing sleeve 559.

The developer having been fed to the developing sleeve 559 is magnetically bound by the action of the magnetic force of the magnet roller 556 and is held on the developing sleeve 559, where it is controlled by a develope-control-member blade 552 and thereby formed into a developer thin layer, during which it is transported to a developing zone G facing the latent-image-bearing member 551 as the developing sleeve 559 is rotated in the direction of an arrow F. At the developing zone G, the developer is used to participate in the development of an electrostatic latent image formed on the latent-image-bearing member 551. Any residual developer having not been consumed in the development is collected into the developer chamber 564.

In the developer chamber 564, the residual developer remaining after development and bound magnetically onto the developing sleeve 559 is so made as to be taken off by the action of a repulsion magnetic field formed between the same-polarity poles S2 and S3. At the upper part of the developing sleeve 559, a scatter-preventive member 566 is fixedly provided in order to prevent the toner from scattering.

What is shown in FIG. 2 is a typical example. Needless to say, there may be various forms with respect of the shape of the container, whether or not the agitation member is provided, the disposition of magnet poles, the direction of rotation, and so forth.

Figure 3:
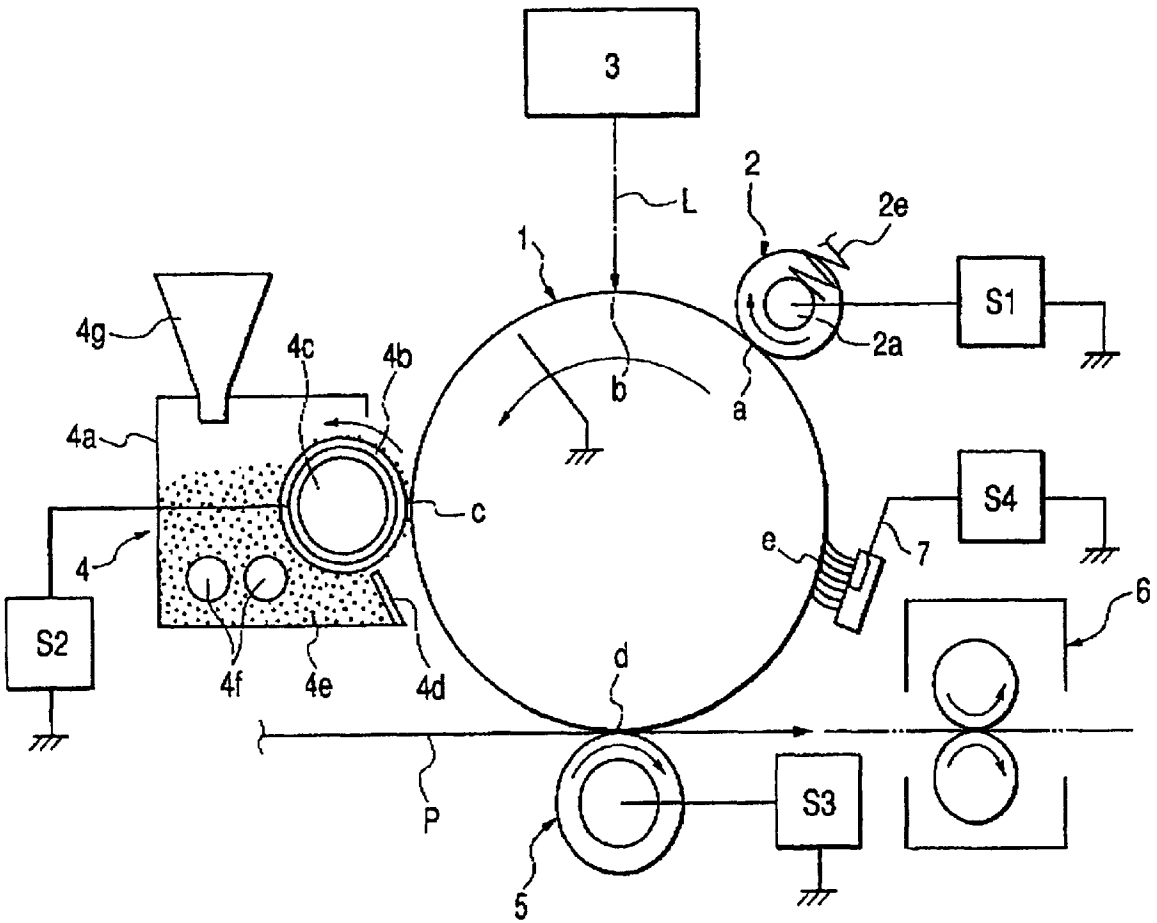
FIG. 3 is a schematic view showing an example of the image-forming apparatus of the present invention.
Figure 4:
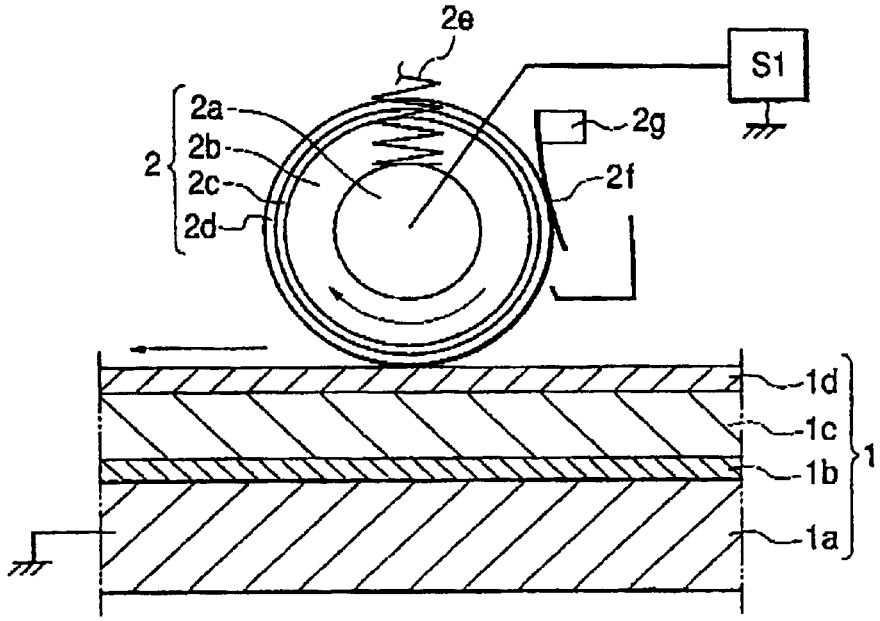
FIG. 4 is a diagrammatic view of the layer construction of a photosensitive drum and that of a charging roller.

Next, an example of the image-forming apparatus according to the present invention is described with reference to the drawings. FIG. 3 is a schematic diagrammatic view showing an example of the construction of an image-forming apparatus according to the present invention. Reference numeral 1 denotes a rotating drum-type electrophotographic photosensitive member (hereinafter "photosensitive drum"). This photosensitive drum 1 is, as shown in FIG. 4, which is a diagrammatic view of a layer construction, so constructed that, on the surface of a cylinder (conductive drum substrate) 1*a* made of aluminum, three layers of a subbing layer 1*b*, which checks the interference of light and improves the adherence of its upper layer, a charge generation layer 1*c*, and a charge transport layer 1*d* are superposed by coating in this order from the lower part.

Reference numeral 2 denotes a contact-charging assembly (contact charger) functioning as a charging means which uniformly electrostatically charges the periphery of the photosensitive drum 1. In this example, it is a charging roller (roller-charging assembly). This charging roller 2 is rotatably supported at the both ends of its mandrel 2*a* by bearing members (not shown), and also is brought into pressure contact with the surface of the photosensitive drum 1 at a stated pressing force, pressing itself in the photosensitive-drum direction by the action of a pressure spring 2*e*. It is rotated following the rotation of the photosensitive drum 1. The part of contact of the photosensitive drum 1 with the charging roller 2 is a charging zone (charging nip) a.

To the mandrel 2*a* of the charging roller 2, a charging bias voltage with stated conditions is applied from a power source S1 so that the periphery of the photosensitive drum 1 is contact charged to stated polarity and potential. In this example, the charging-bias voltage applied to the charging roller 2 is a vibrating voltage formed by superimposing a direct-current voltage (Vdc) and an alternating-current voltage (Vac).

The charging roller 2 has a longitudinal length of 320 mm. It has, as shown in FIG. 4, which is a diagrammatic view of a layer construction, a triple-layer construction in which, on the periphery of a mandrel (support member) 2*a*, a lower layer 2*b*, an intermediate layer 2*c* and a surface layer 2*d* are superposed in this order from the lower part. The lower layer 2*b* is a foamed spongy layer for making a charging sound occur less. The intermediate layer 2*c* is a conductive layer for ensuring an electrical resistance which is uniform as the whole charging roller. The surface layer 2*d* is a protective layer provided in order to prevent any leak from occurring even if there are any defects, such as pinholes, at the surface of the photosensitive drum 1.

In FIG. 4, reference numeral 2*f* denotes a charging-roller cleaning member or cleaning film. In this example, it is a cleaning film having a flexibility. This cleaning film 2*f* is disposed in parallel to the lengthwise direction of the charging roller 2. Also, it is so disposed that its one end is secured to a support member 2*g*, which reciprocates at a constant rate with respect to the same lengthwise direction and so that a nip of contact with the charging roller 2 is formed at a face thereof in the vicinity of the free-end side. The support member 2*g* is driven to reciprocate at a constant rate with respect to the lengthwise direction via a gear train by means of a drive motor, and the charging-roller surface layer 2*d* is rubbed with the cleaning film 2*f*. Thus, any contaminants (such as fine-powder toner and external additives) deposited on the charging-roller surface layer 2*d* are removed.

Reference numeral 3 denotes an exposure unit functioning as an information-writing means which forms an electrostatic latent image on the surface of the photosensitive drum 1 kept charged electrostatically. In this example, it is a laser beam scanner. It emits laser light modulated in accordance with image signals sent to the printer side from a host device, such as an image-reading device (not shown), and subjects the uniformly charged surface of the rotating photosensitive drum 1 to laser-scanning exposure L at an exposure position b. Upon this laser-scanning exposure L, the potential of the surface of the photosensitive drum 1 decreases at its part exposed to the laser light, so that an electrostatic latent image corresponding to the scanning-exposed image information is successively formed on the surface of the photosensitive drum 1.

Reference numeral 4 denotes a developing assembly functioning as a developing means, which feeds a developer (toner) onto the photosensitive drum 1, to render the electrostatic latent image visible. In this example, it is a reversal-developing assembly of a two-component magnetic brush development.

Reference numeral 4*a* denotes a developer container; and reference numeral denotes 4*b* a developing sleeve, which is usually formed of a cylinder of a metal such as aluminum, an alloy thereof stainless steel. The metal may be any of those which can readily be shaped into a cylinder, without any particular limitations. This developing sleeve 4*b* is so provided as to be rotatable in the developer container 4*a* in the state in which its periphery partly stands uncovered to the outside. Reference numeral 4*c* denotes a magnet roller inserted to the inside of the developing sleeve 4*b* in an unrotatably stationary state; reference numeral 4*d* denotes a developer-coating blade; reference numeral 4*e* denotes a two-component developer held in the developer container 4*a*; reference numeral 4*f* denotes a developer-agitation member provided on the bottom side in the developer container 4*a*; and reference numeral 4*g* denotes a toner hopper, in which a replenishing toner is kept held. The two-component developer 4*e* held in the developer container 4*a* is a blend of a toner and a magnetic carrier, and is agitated by means of the developer agitation member 4*f*.

Basically, the toner is triboelectrically charged to a negative polarity upon its friction with the magnetic carrier by the action of agitation of the developer agitation member 4*f*. Also, the toner present on, and in the vicinity of, the developing sleeve 4*b* is also triboelectrically charged upon its friction with the developing sleeve 4*b*. At the surface of the developing sleeve 4*b*, the resin-coat layer as described previously is formed, and the toner is triboelectrically charged to a regular polarity, which is the negative polarity in this example.

The developing sleeve 4*b* is provided to face the photosensitive drum 1 closely, keeping the closest distance from the photosensitive drum 1 at 350 μm (called an S-D gap). This part where the photosensitive drum 1 and the developing sleeve 4*b* face each other is a developing zone c. The developing sleeve 4*b* is rotatingly driven in the direction opposite to the direction of surface movement of the photosensitive drum 1. A part of the two-component developer 4*e* held in the developer container 4*a* is attracted to and held on the periphery of this developing sleeve 4*b* as a magnetic brush layer by the action of the magnetic force of the magnet roller 4*c* set inside the sleeve, and is rotatingly transported with the rotation of the sleeve. It is then layer-controlled to a stated thin layer by means of the developer-coating blade 4*d*, and comes into contact with the surface of the photosensitive drum 1 to rub the photosensitive-drum surface appropriately.

To the developing sleeve 4*b*, a stated development-bias voltage is applied front a power source S2. In this example, the development-bias voltage applied to the developing sleeve 4*b* is a vibrating voltage formed by superimposing a direct-current voltage (Vdc) and an alternating-current voltage (Vac). Thus, the developer is coated in the form of a thin layer on the surface of the developing sleeve 4*b* being rotated, and, by the action of an electric field formed by the development bias, the toner component in the developer transported to the developing zone c adheres selectively to the surface of the photosensitive drum 1 in accordance with the electrostatic latent image, so that the electrostatic latent image is developed as a toner image. In the case of this example, the toner adheres to exposed light areas of the surface of the photosensitive drum 1 and the electrostatic latent image is developed by reverse development.

The developer thin layer on the developing sleeve 4*b* which has passed the developing zone c is returned to the developer-reservoir part inside the developing sleeve 4*b* as the developing sleeve 4*b* is subsequently rotated. In order that the toner concentration of the two-component developer 4*c* in the developer container 4*a* is maintained within a prescribed substantially constant range, the toner concentration of the two-component developer 4*e* in the developer container 4*a* is detected by, e.g., an optical toner-concentration sensor. In accordance with the information gained by this detection, the toner hopper 4*g* is drive controlled and the toner held in the toner hopper is supplied to the two-component developer 4*e* held in the developer container 4*a*. The toner supplied to the two-component developer 4*e* is agitated by the developer-agitation member 4*f*.

Reference numeral 5 denotes a transfer assembly. In this example, it is a transfer roller. This transfer roller 5 is kept in pressure contact with the photosensitive drum 1 under a stated pressing force, and the part of its pressure contact nip is a transfer zone d. To this transfer zone d, a transfer material (an image-transfer member or a recording medium) P is sent from a paper-feed mechanism (not shown) at a given controlled timing.

The transfer material P sent to the transfer zone d is transported in the state it is sandwiched between the photosensitive drum 1 and the transfer roller 5 which are being rotated, in the course of which a transfer bias with a positive polarity, the polarity reverse to the negative polarity, which is the regular charge polarity of the toner, is applied from a power source S3, so that the toner image on the side of the surface of the photosensitive drum 1 is successively electrostatically transferred to the surface of the transfer material P being transported while being sandwiched through the transfer zone d.

The transfer material P to which the toner image has been transferred through the developing zone d is successively separated from the surface of the photosensitive drum 1 being rotated. It is then transported to a fixing assembly 6 (e.g., a heat-roller fixing assembly), where the toner image is fixed, and put out as an image-formed matter (a print or a copy).

Reference numeral 7 denotes a toner-charge-control means, which is a brush-shaped member having an appropriate conductivity, and is so provided that its brush portion is kept in touch with the surface of the photosensitive drum 1. A negative-polarity voltage is applied thereto from a power source S4. Letter symbol e denotes the part of contact of the brush portion with the surface of the photosensitive drum 1. The charge polarity of a transfer residual toner is made uniform to the regular-polarity negative polarity so that the mirror-image force of attraction to the photosensitive drum 1 can be made larger to prevent the transfer residual toner from adhering to the charging roller 2 when the photosensitive drum 1 surface is charged at the charging zone a through the transfer residual toner remaining on the drum surface, the charging zone a being positioned further downstream. The adhesion of toner to the charging roller 2 may cause image defects due to faulty charging. The transfer residual toner having passed the charging roller 2 to become destaticized has a weakened mirror-image force of attraction to the photosensitive drum 1, and is attracted to and held on the drum surface at the developing zone c by the magnetic-brush layer described above, where it is rotatingly transported and collected in the developer chamber as the developing sleeve 4*b* is rotated.

Among the components, for example, the electrostatic-latent-image-bearing member, such as the above photosensitive drum, the developing assembly and the charging means, a plurality of components may integrally be joined as an assembly unit to set up a process cartridge so that this process cartridge is detachably mountable to the main body of the image-forming apparatus. For example, the charging means and the developing assembly may integrally be supported together with the photosensitive drum to form a process cartridge, which may be used as a single unit detachably mountable to the main body of the apparatus, and may be so constructed as to be detachably mountable thereto through a guide means, such as rails, provided in the main body of the apparatus. Here, a cleaning means may be provided together on the part of the process cartridge.

Figure 5:
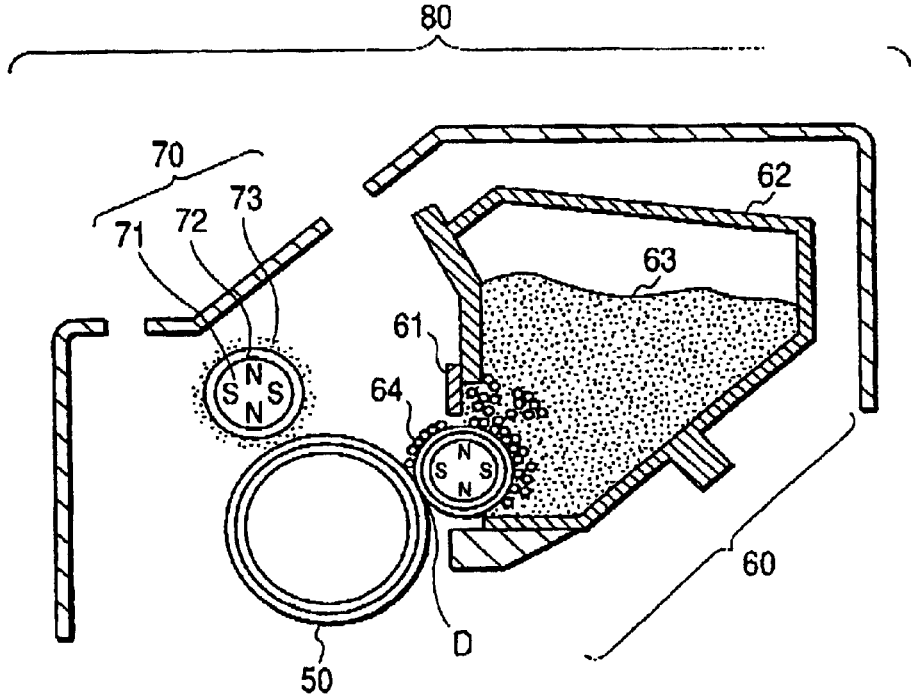
FIG. 5 is a schematic view showing an example of the process cartridge of the present invention.

FIG. 5 is a schematic diagrammatic view showing an example of the construction of the process cartridge according to the present invention. In the embodiment shown in FIG. 5, a process cartridge 80 is exemplified in which a developing assembly 60 functioning as a developing means, and a drum-shaped image-bearing member (photosensitive drum) 50 and a magnetic-brush charging assembly 70 functioning as a primary charging means are integrally set up. The magnetic-brush charging assembly 70 is so constructed that charging magnetic particles 73 are magnetically bound to a charging sleeve 72 by the action of a magnetic force of a magnet 71 enclosed in the charging sleeve 72 to form a magnetic brush. In this embodiment, such a magnetic brush is used as a primary charging means. A charging means, such as a charging blade or a charging roller, may also be used. A non-contact corona charging means may still also be used. However, the contact charging means is preferred because of an advantage that ozone is generated less by this charging means.

The developing assembly 60 has a magnetic control blade 61 and a developer container 62 holding therein a two-component developer 63 having a toner and a magnetic carrier. A developing step is performed by using the toner of the two-component developer 63 and applying a development-bias voltage from a bias-application means at the time of development to form a stated electric field across the photosensitive drum 50 and a developing sleeve 64 as the developer-carrying member.

The development performed by this two-component-developer developing assembly is performed in the state in which a magnetic brush constituted of the toner and the magnetic carrier is in contact with the image-bearing member (e.g., photosensitive drum) 50 under the application of an alternating electric field. By virtue of the contact of this magnetic brush with the image-bearing member, the transfer residual toner held on the image-bearing member after transfer is incorporated in the magnetic brush and then collected in the developer container 62.

The distance between the developer-carrying member (developing sleeve) 64 and the photosensitive drum 50 (distance between S–D), D, may preferably be from 100 to 1,000 $\mu$m. This is favorable for preventing carrier adhesion and improving dot reproducibility. If it is smaller than 100 $\mu$m, the developer tends to be insufficiently fed, resulting in a low image density. If it is larger than 1,000 $\mu$m, the magnetic line of force from the magnet pole S may broaden to make the magnetic brush have a low density, resulting in a poor dot reproducibility, or to weaken the force of binding the carrier, tending to cause carrier adhesion.

The alternating electric field may preferably be applied at a peak-to-peak voltage of from 500 to 5,000 V and a frequency of from 500 to 10,000 Hz, and preferably from 500 to 3,000 Hz, which may each be applied to the process under appropriate selection. In this instance, the waveform used may be selected from a triangular waveform, a rectangular waveform, a sinusoidal waveform and waveform with a varied duty ratio. If the peak-to-peak voltage is lower than 500 V, a sufficient image density may be attained with difficulty, and fog toner at non-image areas can not well be collected in some cases. If it is higher than 5,000 V, the electrostatic latent image may be disordered through the magnetic brush to cause a lowering of image quality.

In the foregoing, an embodiment has been described in which the three components, the developing assembly 60, the image-bearing member 50 and the primary charging assembly 70, are integrally set up into a cartridge. In the present invention, other components, such as a cleaning means, may be added to integrally set up a cartridge.

EXAMPLES

The present invention is described below in greater detail by giving production examples, working examples and comparative examples. In the following, what is expressed as "part(s)" or "%" is by weight unless particularly noted.

Carrier Production Example 1

Phenol and formaldehyde monomers (50:50) were mixed and dispersed in an aqueous medium. Thereafter, based on 100 parts of the monomers, 600 parts of magnetite particles of 0.25 $\mu$m diameter surface treated with a titanium coupling agent and 400 parts of hematite particles of 0.6 $\mu$m diameter were uniformly dispersed, and the monomers were polymerized adding ammonia appropriately to obtain a magnetic-particle-enclosed spherical-magnetic-resin-carrier core material (average particle diameter: 33 $\mu$m; saturated magnetization: 38 $Am^2/kg$).

Meanwhile, 20 parts of toluene, 20 parts of butanol, 20 parts of water and 40 parts of ice were taken into a four-necked flask, and 40 parts of a mixture of 15 mols of $CH_3SiCl_3$ and 10 mols of $(CH_3)_2SiCl_2$ were added thereto with stirring, followed by further stirring for 30 minutes, and thereafter a condensation reaction was carried out at 60° C. for 1 hour. Thereafter, siloxanes formed were thoroughly washed off with water, followed by dissolution in a mixed solvent of toluene, methyl, ethyl ketone and butanol to prepare a silicone varnish with a solid content of 10%.

To this silicone varnish, based on 100 parts of siloxane solid content, 2.0 parts of ion-exchanged water, 2.0 parts of a curing agent, 1.0 part of an aminosilane coupling agent and 5.0 parts of a silane coupling agent were simultaneously added to make up a carrier-coating solution. This solution was coated on 100 parts of the above carrier-core material by means of a coater (Spira Coater, manufactured by Okada Seikosha K-K.) so as to be in a resin coating weight of 1 part. Thus, a coated carrier production example 1 was obtained. This coated carrier 1 had a volume resistivity of $4\times10^{13}$ $\Omega\cdot$cm and a weight-average particle diameter of 33.8 $\mu$m.

Carrier Production Example 2

A coated carrier production example 2 was obtained in the same manner as in Carrier Production Example 1 except that conditions for polymerization were changed. This coated carrier production example 2 had a volume resistivity of $7\times10^{13}$ $\Omega\cdot$cm and a weight-average particle diameter of 57.8 $\mu$m.

Carrier Production Example 3

A coated carrier production example 3 was obtained in the same manner as in Carrier Production Example 1 except that conditions for polymerization were changed. This coated carrier production example 3 had a volume resistivity of $8\times10^{13}$ $\Omega\cdot$cm and a weight-average particle diameter of 18.2 $\mu$m.

Toner Production Example

Into a 2-liter four-necked flask having a high-speed stirrer TK-type homomixer, 880 parts of ion-exchanged water, and 450 parts of an aqueous 0.1 mol/liter Na3PO4 solution were introduced, and the mixture was heated to 58° C. with stirring at 12,000 rpm. Then, 68 parts of an aqueous 1.0 mol/liter $CaCl_2$ solution was added thereto little by little to prepare a dispersion medium containing fine-particle slightly water-soluble dispersant $Ca_3(PO_4)_2$.

Meanwhile, as a disperse phase (dispersoid), the following was prepared.

| | |
|---|---|
| Styrene monomer | 170 parts |
| n-Butyl acrylate monomer | 30 parts |
| C.I. Pigment Blue 15:3 | 14 parts |
| Polyester resin (obtained by mixing terephthalic acid and propylene oxide addition bisphenol A in a molar ratio of 50:50, followed by condensation polymerization | 8 parts |

-continued

| | |
|---|---|
| Salicylic acid chromium compound (negative-charging charge control agent) | 2 parts |
| Ester wax | 20 parts |

A mixture of the above materials was dispersed for 3 hours by means of an attritor. To the dispersion obtained, 10 parts of a polymerization initiator 2,2'-azobis (2,4-dimethylvaleronitrile) was added to obtain a dispersion. This was introduced into the above dispersion medium to carry out granulation for 12 minutes while maintaining the number of revolutions of the high-speed stirrer. Thereafter, the high-speed stirrer was changed for a stirrer having propeller stirring blades, and its internal temperature was raised to 80° C. to continue polymerization for 10 hours at 50 rpm. After the polymerization was completed, the slurry formed was cooled, and diluted hydrochloric acid was added to remove the dispersant, further followed by washing and drying to obtain cyan toner particles. The cyan toner particles had a weight-average particle diameter (D4) of 8.3 $\mu$m.

To 100 parts by weight of the above toner particles, 1.3 parts of hydrophobic fine silica powder treated with hexamethyldisilazane (BET specific surface area: 300 $m^2/g$) and 0.5 parts of strontium titanate were added, and these were mixed by means of a Henschel mixer to obtain a cyan toner. Then, this cyan toner and the above carriers 1 to 3 were so blended as to have a toner concentration of 8% to obtain developers (cyan two-component developers) 1 to 3, respectively.

Example 1

As the solid particles, those obtained in the following way were used: 100 parts of spherical phenol-resin particles with a number-average particle diameter of 12.1 $\mu$m were uniformly coated with 14 parts of coal bulk-mesophase pitch powder with a number-average particle diameter of 2 $\mu$m or less by means of an automated mortar (manufactured by Ishikawa Kojyo) Then, the coated particles were subjected to thermal stabilization treatment at 280° C. in air, followed by firing at 2,000° C. in an atmosphere of nitrogen to graphitize them, and further followed by classification to obtain spherical conductive carbon particles, solid particles A-1, having a number-average particle diameter of 11.9 $\mu$m and an average circularity of 0.9.

These solid particles A-1 had a true density of 1.5 $g/cm^3$ and a volume resistivity of $8.5\times10^{-2}$ $\Omega\cdot$cm,

| | |
|---|---|
| Carbon black | 15 parts |
| Crystalline graphite with number-average particle diameter of 3.2 $\mu$m and average circularity of 0.59 | 85 parts |
| Resol type phenol resin solution (solid content: 50%) | 600 parts |
| Solid particles A-1 | 100 parts |
| MEK (methyl ethyl ketone) | 200 parts |

A mixture of the above materials was dispersed for 3 hours by means of a sand mill, using zirconia particles of 2 mm in diameter. Thereafter, the zirconia particles were separated by sieving. The solid content of the dispersion obtained was adjusted with MEK to 40% to obtain a coating fluid (C(carbon)/GF(graphite)/B(phenol resin)/R(solid particles)=0.15/0.85/3/1.0 (weight ratio)). This coating fluid was coated on an aluminum cylinder substrate of 16 mm diameter by spraying to form a coating of 15 $\mu$m thick, followed by heating and curing at 150° C. for 30 minutes using a hot air dryer to produce a developer-carrying member (developing sleeve) B-1. Physical properties of this developing sleeve B-1 are shown in Table 2.

Next, a commercially available copying machine CP2150 (manufactured by CANON INC.) was remodeled to the image-forming apparatus as shown in FIG. 2. The above developing sleeve was used as the developer-carrying member. Using as the charging member the charging roller shown in FIG. 3, the photosensitive member was electrostatically charged under superimposing application of AC/DC electric fields (−500 V, 1 kHz/1.4 kVpp). A cleaning unit was detached. Setting the development contrast at 350 V and the fog take-off reversal contrast at −150 V, a development bias having a discontinuous alternating electric field was applied. Using the above cyan two-component developer 1, images were reproduced on up to 30,000 sheets in each environment of 23.5° C./10% RH (normal temperature and low humidity (N/L)) and 30.0° C./80% RH (high temperature and high humidity (H/H)), and an evaluation was made on the following items. The results obtained are shown in Tables 4 and 5 given later.

(1) Image density

A test chart with black circles of 5 mm diameter in an image area percentage of 5.5% was copied, and the image density of copied images was measured with a reflection densitometer RD918 (manufactured by Macbeth Co.) to examine how the image density was maintainable.

(2) Developer transport quantity on developing sleeve (M/S):

The developer held on the developing sleeve was collected by suction using a metallic cylindrical tube and a cylindrical filter. Prom the weight M of the developer collected and the area S where the developer was sucked, the value of M/S per unit area ($mg/cm^2$) was calculated. The value found was regarded as the developer transport quantity (M/S).

(3) Toner contamination of the developing sleeve surface (resistance to contamination):

The surface of the developing sleeve after extensive operation (running) was observed by SEM (scanning electron microscopy) to make an evaluation according to the following evaluation criteria.

A: No contamination is seen at all.

B: Contamination is seen to a small extent, but on a level that is not problematic in practical use.

C: Much contaminant toner is present on the developing-sleeve surface, but on a level that it affects images to a small extent.

D: Much contamination is seen, and on a level it affects images and is problematic in practical use.

E: Contamination and image deterioration occur greatly.

(4) Abrasion of developing-sleeve surface (resistance to abrasion):

The outer diameter of the developing sleeve before image reproduction is previously measured (an average at 10 spots) with a laser length meter, and its outer diameter after extensive operation is measured with the laser length meter. The value of (outer diameter before image reproduction)—(outer diameter after extensive operation) is expressed in units of $\mu$m as the abrasion level.

(5) Measurement of surface roughness (Ra, Rz) before and after extensive operation:

Surface roughness is measured with SURFCOADER SE-3500 (trade name), manufactured by Kosaka Laboratory Ltd., on 5 spots in the axial direction×2 spots in the peripheral direction=10 spots in measurement length of 4 mm, and the measurements obtained were averaged. As shown in FIGS. 4 and 5, good results were obtained.

Example 2

A developing sleeve B-2 was produced in the same manner as in Example 1 except that the solid particles A-1 used therein were added in an amount of 30 parts. An evaluation was made in the same manner as in Example 1.

Example 3

A developing sleeve B-3 was produced in the same manner as in Example 1 except that the solid particles A-1 used therein were added in an amount of 180 parts. An evaluation was made in the same manner as in Example 1.

Example 4

As the solid particles, those obtained in the following way were used: 100 parts of spherical phenol-resin particles with a number-average particle diameter of 3.4 μm were uniformly coated with 14 parts of coal bulk-mesophase pitch powder with a number-average particle diameter of 1.4 μm or less by means of an automated mortar (manufactured by Ishikawa Kojyo). Then, the Coated particles were subjected to thermal stabilization treatment at 280° C. in air, followed by firing at 2,000° C. in an atmosphere of nitrogen to graphitize them, and further followed by classification to obtain spherical conductive carbon particles with a number-average particle diameter of 3.3 μm, solid particles A-2.

Next, a developing sleeve B-4 was produced in the same manner as in Example 1 except that, in place of the solid particles A-1 used therein and added in an amount of 100 parts, the solid particles A-2 were added in an amount of 140 parts. Image reproduction was tested in the same manner as in Example 1.

Example 5

As the solid particles, those obtained in the following way were used: 100 parts of spherical phenol-resin particles with a number-average particle diameter of 20.1 μm were uniformly coated with 14 parts of coal bulk-mesophase pitch powder with a number-average particle diameter of 1.4 μm or less by means of an automated mortar (manufactured by Ishikawa Kojyo). Then, the coated particles were subjected to thermal stabilization treatment at 280° C. in air, followed by firing at 2,000° C. in an atmosphere of nitrogen to graphitize them, and further followed by classification to obtain spherical conductive carbon particles with a number-average particle diameter of 19.8 μm, solid particles A-3.

Next, a developing sleeve B-5 was produced in the same manner as in Example 1 except that, in place of the solid particles A-1 used therein and added in an amount of 100 parts, the solid particles A-3 were added in an amount of 140 parts. Image reproduction was tested in the same manner as in Example 1.

Example 6

As the solid particles, those obtained in the following way were used: 100 parts of spherical phenol-resin particles with a number-average particle diameter of 10.9 μm were uniformly coated with 14 parts of coal bulk-mesophase pitch powder with a number-average particle diameter of 1.4 μm or less by means of an automated mortar (manufactured by Ishikawa Kojyo). Then, the coated particles were subjected to thermal stabilization treatment at 280° C. in air, followed by firing at 1,000° C. in an atmosphere of nitrogen to carbonize them, and further followed by classification to obtain spherical conductive carbon particles with a number-average particle diameter of 7.5 μm, which were further coated with copper and silver to obtain metal coated carbon particles with a number-average particle diameter of 12.2 μm, solid particles A-4.

Next, a developing sleeve B-6 was produced in the same manner as in Example 1 except that, in place of the solid particles A-1 used therein and added in an amount of 100 parts, the solid particles A–d were added in an amount of 100 parts. Image reproduction was tested in the same manner as in Example 1.

Example 7

As the solid particles, those obtained in the following way were used: Using the materials shown below, kneading, pulverization and classification were carried out to obtain conductive particles with a number-average particle diameter of 10.9 μm. Thereafter, to make the particles spherical, the conductive particles were stirred in hot water together with an inorganic dispersant to obtain conductive spherical resin particles, solid particles A-5.

| | |
|---|---|
| Styrene-acrylic resin | 100 parts |
| Conductive carbon black | 25 parts |

Next, a developing sleeve B-7 was produced in the same manner as in Example 1 except that, in place of the solid particles A-1 used therein and added in an amount of 100 parts, the solid particles A-5 were added in an amount of 100 parts. Image reproduction was tested in the sane manner as in Example 1.

Example 8

As the solid particles, non-conductive spherical PMMA particles with a number-average particle diameter of 14.3 μm, solid particles A-6, were used.

Next, a developing sleeve B-8 was produced in the same manner as in Example 1 except that, in place of the solid particles A-1 used therein and added in an amount of 100 parts, the solid particles A-6 were added in an amount of 100 parts. Image reproduction was tested in the same manner as in Example 1.

Example 9

As the solid particles, boron carbide particles with a number-average particle diameter of 12.9 μm, solid particles A-7, were used.

Next, a developing sleeve B-9 was produced in the same manner as in Example 1 except that, in place of the solid particles A-1 used therein and added in an amount of 100 parts, the solid particles A-7 were added in an amount of 100 parts. Image reproduction was tested in the same manner as in Example 1.

Example 10

As the solid particles, titanium oxide particles with a number-average particle diameter of 7.9 μm, solid particles A-8, were used.

Next, a developing sleeve B-10 was produced in the same manner as in Example 1 except that, in place of the solid particles A-1 used therein and added in an amount of 100 parts, the solid particles A–B were added in an amount of 100 parts. Image reproduction was tested in the same manner as in Example 1.

Example 11

As the solid particles, iron particles with a number-average particle diameter of 8.2 μm, solid particles A-9, were used.

Next, a developing sleeve B-11 was produced in the same manner as in Example 1 except that, in place of the solid particles A-1 used therein and added in an amount of 100 parts, the solid particles A-9 were added in an amount of 100 parts. Image reproduction was tested in the same manner as in Example 1.

Example 12

As the solid particles, aluminum borate particles with a number-average particle diameter of 11.6 μm, solid particles A-10, were used.

Next, a developing sleeve B-12 was produced in the same manner as in Example 1 except that, in place of the solid particles A-1 used therein and added in an amount of 100 parts, the solid particles A-10 were added in an amount of 100 parts. Image reproduction was tested in the same manner as in Example 1.

Example 13

As the solid particles, crystalline silica particles with a number-average particle diameter of 13.8 μm, solid particles A-11, were used.

Next, a developing sleeve B-13 was produced in the same manner as in Example 1 except that, in place of the solid particles A-1 used therein and added in an amount of 100 parts, the solid particles A-11 were added in an amount of 100 parts. Image reproduction was tested in the same manner as in Example 1.

Example 14

| | |
|---|---|
| Carbon black | 15 parts |
| Crystalline graphite with a number-average particle diameter of 3.2 μm and average circularity of 0.59 | 85 parts |
| Methyl methacrylate-dimethylaminoethyl methacrylate copolymer (solid content: 40%) (molar ratio: 90:10; Mw: 10,200; Mn: 4,500; Mw/Mn: 2.3) | 720 parts |
| Solid particles A-1 | 100 parts |
| MEK | 200 parts |

The above materials were dispersed in the same manner as in Example 1 to prepare a coating fluid. Using this coating fluid, a developing sleeve B-14 was produced in the same manner as in Example 1. Image reproduction was tested in the same manner as in Example 1.

Example 15

| | |
|---|---|
| Carbon black | 15 parts |
| Crystalline graphite with a number-average particle diameter of 3.2 μm and average circularity of 0.59 | 85 parts |
| Polyester resin solution (solid content: 50%) | 300 parts |
| Solid particles A-1 | 80 parts |

-continued

| | |
|---|---|
| Imidazole compound particles (charge control particles) C-1 shown below | 30 parts |
| MEK | 200 parts |

C-1

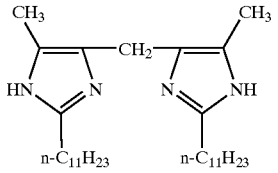

The above materials were dispersed in the same manner as in Example 1 to prepare a coating fluid. Using this coating fluid, a developing sleeve B-15 was produced in the same manner as in Example 1. Image reproduction was tested in the same manner as in Example 1.

Example 16

A developing sleeve B-16 was produced in the same manner as in Example 15 except that the polyester resin used therein in the coating fluid was changed for acryl-modified silicone resin. Image reproduction was tested in the same manner as in Example 1.

Example 17

A developing sleeve B-17 was produced in the same manner as in Example 15 except that the polyester resin used therein in the coating fluid was changed for resol-type phenol resin. Image reproduction was tested in the same manner as in Example 1.

Example 18

As charge-control particles, imidazole compound particles with a number-average particle diameter of 9.6 μm, represented by the following formula C-2, were used.

C-2

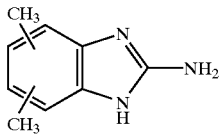

Next, a developing sleeve B-18 was produced in the same manner as in Example 17 except that the particles C-1 used therein were changed for the particles C-2. Image reproduction was tested in the same manner as in Example 1.

Example 19

| | |
|---|---|
| Carbon black | 15 parts |
| Crystalline graphite with a number-average particle diameter of 3.2 μm and an average circularity of 0.59 | 85 parts |
| Resol-type phenol resin (solid content: 50%) | 600 parts |
| Methyl methacrylate-dimethylaminoethyl methacrylate copolymer (solid content: 40%) (molar ratio: 90:10; Mw: 10,200; Mn: 4,500; Mw/Mn: 2.3) | 120 parts |
| Solid particles A-1 | 100 parts |
| MEK | 200 parts |

The above materials were dispersed in the same manner as in Example 1 to prepare a coating fluid. Using this coating fluid, a developing sleeve B-19 was produced in the same manner as in Example 1. Image reproduction was tested in the same manner as in Example 1.

Example 20

A developing sleeve B-20 was produced in the same manner as in Example 4 except that, in place of the solid particles A-2 used therein and added in an amount of 140 parts, the same was added in an amount of 20 parts. Image reproduction was tested in the same manner as in Example 1.

Example 21

Image reproduction was tested in the same manner as in Example 3 except that the developer 1 used therein was changed for the developer 2.

Example 22

Image reproduction was tested in the same manner as in Example 13 except that the developer 1 used therein was changed for the developer 2.

Example 23

Image reproduction was tested in the same manner as in Example 2 except that the developer 1 used therein was changed for the developer 3.

Example 24

Image reproduction was tested in the same manner as in Example 11 except that the developer 1 used therein was changed for the developer 3.

Comparative Example 1

A developing sleeve D-1 was produced in the same manner as in Example 1 except that the solid particles A-1 used therein were removed. Image reproduction was tested in the same manner as in Example 1.

Comparative Example 2

An aluminum cylinder substrate of 16 mm diameter whose surface was subjected to sand blasting was used in the developing sleeve substrate. Except for this, spray coating was carried out in the same formulation as in Comparative Example 1 to produce a developing sleeve D-2. Image reproduction was tested in the same manner as in Comparative Example 1.

Comparative Example 3

An aluminum cylinder substrate of 16 mm diameter whose surface was subjected to sand blasting was used in the developing sleeve substrate. Spray coating was carried out in the same formulation as in Comparative Example 1, except that the solid particles A-1 of Example 1 were changed for crystalline graphite, with a number-average particle diameter of 9.8 $\mu$m and an average circularity of 0.57, solid particles A-12, to produce a developing sleeve D-3. Image reproduction was tested in the same manner as in Comparative Example 1.

Comparative Example 4

Image reproduction was tested in the same manner as in Comparative Example 1 except that the developer 1 used therein was changed for the developer 2.

Comparative Example 5

Image reproduction was tested in the same manner as in Comparative Example 2 except that the developer 1 used therein was changed for the developer 2.

Comparative Example 6

A developing sleeve D-4 was produced in the same manner as in Example 4 except that, in place of the solid particles A-2 used therein and added in an amount of 140 parts, the same was added in an amount of 20 parts. Image reproduction was tested in the same manner as in Comparative Example 2 except that the developer 1 used therein was changed for the developer 2.

Physical properties of the solid particles A-1 to A-12 used in the foregoing Production Examples, Examples and Comparative Examples are shown in Table 1. The construction of the developing sleeves used in the foregoing Production Examples, Examples and Comparative Examples are also shown in Table 2. The construction of the resin coat layers of the developing sleeves are still also shown in Table 3. The results of evaluation made in the foregoing Examples and Comparative Examples are further shown in Table 4.

TABLE 1

Physical properties of solid particles

| Kinds of particles | Composition | Number-average particle diameter ($\mu$m) | Average circularity SF-1 |
|---|---|---|---|
| A-1 | Carbon particles | 11.9 | 0.9 |
| A-2 | Carbon particles | 3.3 | 0.93 |
| A-3 | Carbon particles | 19.8 | 0.88 |
| A-4 | Cu, Ag-plated carbon particles | 12.2 | 0.85 |
| A-5 | Carbon black-dispersed resin particles | 10.9 | 0.87 |
| A-6 | PMMA particles | 14.3 | 0.82 |
| A-7 | Boron carbide particles | 12.9 | 0.68 |
| A-8 | Titanium oxide particles | 7.9 | 0.74 |
| A-9 | Iron particles | 8.2 | 0.73 |
| A-10 | Aluminum borate particles | 11.6 | 0.77 |
| A-11 | Crystalline silica particles | 13.8 | 0.79 |
| A-12 | Crystalline graphite particles | 9.8 | 0.57 |

TABLE 2

| Developer carrying member | Compositional ratio of coat layer | Binder resin | solid particles | Additive | Ru (μm) | Rz (μm) | Rp (μm) | Rv (μm) |
|---|---|---|---|---|---|---|---|---|
| | | Construction of developing sleeve | | | | | | |
| B-1 | C/Gf/B/R = 0.15/0.85/3/1.0 | Phenol | A-1 | — | 2.13 | 13.86 | 8.32 | 5.16 |
| B-2 | C/Gf/B/R = 0.15/0.85/3/0.3 | ↑ | ↑ | — | 1.39 | 11.92 | 7.94 | 5.46 |
| B-3 | C/Gf/B/R = 0.15/0.85/3/1.8 | ↑ | ↑ | — | 2.68 | 15.42 | 10.92 | 7.18 |
| B-4 | C/Gf/B/R = 0.15/0.85/3/1.4 | ↑ | A-2 | — | 1.82 | 10.04 | 6.41 | 4.53 |
| B-5 | C/Gf/B/R = 0.15/0.85/3/0.6 | ↑ | A-3 | — | 2.21 | 19.21 | 12.28 | 9.13 |
| B-6 | C/Gf/B/R = 0.15/0.85/3/1.0 | ↑ | A-4 | — | 2.19 | 14.12 | 8.71 | 6.42 |
| B-7 | ↑ | ↑ | A-5 | — | 2.03 | 13.36 | 9.2 | 5.99 |
| B-8 | ↑ | ↑ | A-6 | — | 2.22 | 14.48 | 9.18 | 6.1 |
| B-9 | ↑ | ↑ | A-7 | — | 2.43 | 16.62 | 11.05 | 7.56 |
| B-10 | ↑ | ↑ | A-8 | — | 1.79 | 10.62 | 7.87 | 4.92 |
| B-11 | ↑ | ↑ | A-9 | — | 1.85 | 11.03 | 6.59 | 4.1 |
| B-12 | ↑ | ↑ | A-10 | — | 1.43 | 11.27 | 6.42 | 4.73 |
| B-13 | ↑ | ↑ | A-11 | — | 2.59 | 17.86 | 12.01 | 8.84 |
| B-14 | ↑ | MMA-DM | A-1 | — | 2.18 | 13.61 | 8.74 | 5.51 |
| B-15 | C/Gf/B/R/Z = 0.15/0.85/3/0.8/0.3 | Polyester | ↑ | C-1 | 2.06 | 13.36 | 8.88 | 6.03 |
| B-16 | ↑ | Acryl-modified silicone | ↑ | ↑ | 2.23 | 13.71 | 8.49 | 5.01 |
| B-17 | ↑ | Phenol | ↑ | ↑ | 2.25 | 14.06 | 8.73 | 5.42 |
| B-18 | ↑ | ↑ | ↑ | C-2 | 2.19 | 15.1 | 9.41 | 6.22 |
| B-19 | ↑ | ↑ | ↑ | C-3 | 2.31 | 14.28 | 8.42 | 5.28 |
| B-20 | C/Gf/B/R = 0.15/0.85/3/0.2 | ↑ | A-2 | — | 1.16 | 8.49 | 6.42 | 3.29 |
| D-1 | C/Gf/B/R = 0.15/0.85/3 | ↑ | — | — | 0.78 | 5.42 | 2.96 | 3.05 |
| D-2 | ↑ | ↑ | — | — | 1.21 | 7.89 | 4.49 | 4.32 |
| D-3 | C/Gf/B/R = 0.15/0.85/3/1.0 | ↑ | A-12 | — | 2.26 | 16.74 | 9.86 | 8.72 |
| D-4 | C/Gf/B/R = 0.15/0.85/3/0.2 | ↑ | A-2 | — | 1.12 | 8.01 | 5.01 | 4.88 |

TABLE 3

| | Construction of coat layer of developing sleeve | | | | | |
|---|---|---|---|---|---|---|
| | Conductive cover layer construction | | | | | |
| | Developer carrying member | Carrier diameter r | S (%) | r/Rp | Rp/Rv | Rz/Rv |
| Example 1 | B-1 | 33.8 | 18.2 | 4.06 | 1.61 | 2.69 |
| Example 2 | B-2 | ↑ | 8.4 | 4.26 | 1.45 | 2.18 |
| Example 3 | B-3 | ↑ | 20.1 | 3.10 | 1.52 | 2.15 |
| Example 4 | B-4 | ↑ | 5.3 | 5.27 | 1.42 | 2.22 |
| Example 5 | B-5 | ↑ | 18.8 | 2.75 | 1.35 | 2.10 |
| Example 6 | B-6 | ↑ | 16.4 | 3.88 | 1.36 | 2.20 |
| Example 7 | B-7 | ↑ | 14.8 | 3.67 | 1.54 | 2.23 |
| Example 8 | B-8 | ↑ | 15.5 | 3.68 | 1.50 | 2.37 |
| Example 9 | B-9 | ↑ | 19.2 | 3.81 | 1.47 | 2.22 |
| Example 10 | B-10 | ↑ | 7.2 | 3.98 | 1.69 | 2.74 |
| Example 11 | B-11 | ↑ | 6.1 | 3.87 | 1.61 | 2.59 |
| Example 12 | B-12 | ↑ | 7.8 | 3.59 | 1.51 | 2.43 |
| Example 13 | B-13 | ↑ | 16.4 | 4.01 | 1.59 | 2.70 |
| Example 14 | B-14 | ↑ | 15.8 | 3.87 | 1.59 | 2.47 |
| Example 15 | B-15 | ↑ | 16.4 | 3.81 | 1.47 | 2.22 |
| Example 16 | B-16 | ↑ | 17.2 | 3.98 | 1.69 | 2.74 |
| Example 17 | B-17 | ↑ | 17.5 | 3.87 | 1.61 | 2.59 |
| Example 18 | B-18 | ↑ | 14.2 | 3.59 | 1.51 | 2.43 |
| Example 19 | B-19 | ↑ | 16.3 | 4.01 | 1.59 | 2.70 |
| Example 20 | B-20 | ↑ | 4.06 | 5.27 | 1.95 | 2.58 |
| Example 21 | B-3 | 57.8 | 8.9 | 5.29 | 1.52 | 2.15 |

TABLE 3-continued

| | Construction of coat layer of developing sleeve | | | | | |
|---|---|---|---|---|---|---|
| | Conductive cover layer construction | | | | | |
| | Developer carrying member | Carrier diameter r | S (%) | r/Rp | Rp/Rv | Rz/Rv |
| Example 22 | B-13 | ↑ | 7.8 | 4.81 | 1.59 | 2.70 |
| Example 23 | B-2 | 18.2 | 14.4 | 2.29 | 1.45 | 2.18 |
| Example 24 | B-11 | ↑ | 11.2 | 2.76 | 1.61 | 2.59 |
| Comparative Example 1 | D-1 | 33.8 | 1.42 | 11.42 | 0.97 | 1.78 |
| Comparative Example 2 | D-2 | ↑ | 3.88 | 7.53 | 1.04 | 1.83 |
| Comparative Example 3 | D-3 | ↑ | 14.4 | 3.43 | 1.13 | 1.92 |
| Comparative Example 4 | D-1 | 57.8 | 0 | 19.53 | 0.97 | 1.78 |
| Comparative Example 5 | D-2 | ↑ | 0.04 | 12.87 | 1.04 | 1.83 |
| Comparative Example 6 | D-4 | ↑ | 0.35 | 8.92 | 1.95 | 2.58 |

TABLE 4

N/L evaluation results

| | Image density | | | Resistance to contamination | M/S (dg/) | | | Abrasion level | Sleeve Ra | | Sleeve Rz | |
|---|---|---|---|---|---|---|---|---|---|---|---|---|
| | initial | 5000 sheets | 50000 sheets | 50000 sheets | initial | 5000 sheets | 50000 sheets | 50000 sheets | Initial | 50000 sheets | Initial | 50000 sheets |
| Example 1 | 1.55 | 1.55 | 1.53 | A | 25.5 | 25.1 | 24.5 | 0.6 | 2.13 | 2.02 | 13.86 | 12.11 |
| Example 2 | 1.49 | 1.48 | 1.45 | A | 24.1 | 23.9 | 22.7 | 1.1 | 1.39 | 1.21 | 11.92 | 9.56 |
| Example 3 | 1.55 | 1.52 | 1.50 | A | 26.1 | 25.5 | 24.6 | 0.5 | 2.68 | 2.40 | 15.42 | 13.20 |
| Example 4 | 1.54 | 1.53 | 1.51 | A | 25.4 | 25.6 | 25.0 | 0.5 | 1.82 | 1.69 | 10.04 | 8.87 |
| Example 5 | 1.52 | 1.51 | 1.48 | A | 25.8 | 25.2 | 24.2 | 0.9 | 2.21 | 2.08 | 19.21 | 16.91 |
| Example 6 | 1.51 | 1.52 | 1.48 | A | 25.3 | 25.0 | 24.2 | 0.7 | 2.19 | 2.04 | 14.12 | 12.83 |
| Example 7 | 1.52 | 1.50 | 1.45 | B | 24.8 | 74.5 | 23.2 | 2.4 | 2.03 | 1.83 | 13.36 | 11.52 |
| Example 8 | 1.53 | 1.48 | 1.44 | B | 25.2 | 24.9 | 23.8 | 2.9 | 2.22 | 1.99 | 14.48 | 11.43 |
| Example 9 | 1.52 | 1.49 | 1.47 | A | 25.8 | 25.3 | 24.4 | 0.9 | 2.43 | 2.23 | 16.62 | 14.13 |
| Example 10 | 1.50 | 1.51 | 1.48 | A | 24.8 | 24.4 | 23.5 | 0.4 | 1.52 | 1.42 | 12.02 | 10.51 |
| Example 11 | 1.53 | 1.52 | 1.51 | A | 24.1 | 23.8 | 23.0 | 0.6 | 1.39 | 1.25 | 10.69 | 9.12 |
| Example 12 | 1.52 | 1.53 | 1.52 | A | 24.5 | 24.4 | 24.1 | 0.2 | 1.43 | 1.38 | 11.27 | 10.25 |
| Example 13 | 1.51 | 1.48 | 1.42 | B | 25.4 | 24.9 | 23.5 | 3.0 | 2.59 | 2.20 | 17.86 | 13.14 |
| Example 14 | 1.54 | 1.51 | 1.50 | A | 25.2 | 24.6 | 24.0 | 1.6 | 2.18 | 1.88 | 13.61 | 11.49 |
| Example 15 | 1.48 | 1.46 | 1.41 | B | 25.5 | 24.7 | 23.9 | 1.1 | 2.06 | 2.86 | 13.36 | 11.17 |
| Example 16 | 1.47 | 1.45 | 1.41 | B | 25.8 | 24.6 | 23.7 | 1.9 | 2.23 | 1.97 | 13.71 | 11.32 |
| Example 17 | 1.51 | 1.50 | 1.49 | A | 25.1 | 24.8 | 24.2 | 1.2 | 2.25 | 2.10 | 14.06 | 12.89 |
| Example 18 | 1.51 | 1.49 | 1.48 | A | 25.1 | 24.7 | 24.4 | 1.5 | 2.19 | 1.99 | 15.12 | 13.03 |
| Example 19 | 1.55 | 1.54 | 1.54 | A | 25.3 | 25.1 | 24.6 | 1.4 | 2.31 | 2.14 | 14.28 | 12.38 |
| Example 20 | 1.51 | 1.48 | 1.46 | C | 24.8 | 23.1 | 21.2 | 2.1 | 1.12 | 1.01 | 8.01 | 7.02 |
| Example 21 | 1.50 | 1.49 | 1.46 | A | 26.5 | 25.7 | 24.9 | 2.4 | 2.68 | 2.29 | 15.42 | 12.87 |
| Example 22 | 1.51 | 1.48 | 1.45 | B | 26.1 | 25.2 | 24.5 | 2.9 | 2.59 | 2.02 | 17.86 | 12.29 |
| Example 23 | 1.51 | 1.50 | 1.44 | B | 24.2 | 23.7 | 22.9 | 0.5 | 1.39 | 1.30 | 11.92 | 10.47 |
| Example 24 | 1.53 | 1.51 | 1.43 | B | 24.9 | 24.2 | 23.6 | 0.3 | 1.39 | 1.33 | 10.69 | 10.02 |
| Comparative | 1.41 | 1.22 | 0.94 | D | 24.1 | 19.8 | 15.9 | 6.7 | 0.78 | 0.45 | 5.42 | 3.52 |
| Comparative | 1.42 | 1.39 | 1.29 | D | 24.4 | 22.2 | 19.9 | 6.2 | 1.21 | 0.92 | 7.89 | 6.13 |
| Comparative | 1.47 | 1.40 | 1.26 | D | 25.9 | 23.8 | 20.9 | 7.7 | 2.26 | 1.48 | 16.74 | 10.29 |
| Comparative | 1.43 | 1.20 | 0.85 | E | 24.2 | 18.5 | 12.2 | 8.9 | 0.78 | 0.40 | 5.42 | 3.16 |
| Comparative | 1.45 | 1.38 | 1.25 | D | 24.8 | 19.7 | 15.5 | 7.7 | 1.21 | 0.89 | 7.89 | 5.99 |
| Comparative | 1.51 | 1.45 | 1.40 | C | 24.6 | 22.9 | 20.8 | 3.6 | 1.12 | 0.91 | 8.01 | 6.52 |

TABLE 5

H/H evaluation results

| | Image density | | | Resistance to contamination | M/S (dg/) | | | Abrasion level | Sleeve Ra | | Sleeve Rz | |
|---|---|---|---|---|---|---|---|---|---|---|---|---|
| | initial | 5000 sheets | 50000 sheets | 50000 sheets | Initial | 5000 sheets | 50000 sheets | 50000 sheets | Initial | 5000 sheets | Initial | 5000 sheets |
| Example 1 | 1.50 | 1.49 | 1.46 | A | 25.1 | 24.9 | 24.6 | 0.7 | 2.13 | 1.95 | 13.86 | 11.94 |
| Example 2 | 1.44 | 1.43 | 1.39 | A | 24.2 | 24.0 | 23.8 | 2.0 | 1.39 | 1.11 | 11.92 | 9.09 |
| Example 3 | 1.51 | 1.47 | 1.43 | A | 25.6 | 25.4 | 24.8 | 0.8 | 2.68 | 2.29 | 15.42 | 12.87 |
| Example 4 | 1.49 | 1.46 | 1.41 | A | 24.9 | 24.5 | 24.2 | 2.4 | 1.82 | 1.54 | 10.04 | 8.41 |
| Example 5 | 1.48 | 1.44 | 1.40 | A | 25.5 | 25.3 | 25.0 | 2.0 | 2.21 | 1.97 | 19.21 | 16.42 |
| Example 6 | 1.48 | 1.45 | 1.41 | A | 25.1 | 24.7 | 24.2 | 2.1 | 2.19 | 1.92 | 14.12 | 12.25 |
| Example 7 | 1.48 | 1.45 | 3.39 | B | 25.2 | 24.4 | 23.5 | 3.5 | 2.03 | 1.74 | 13.36 | 10.99 |
| Example 8 | 1.47 | 1.43 | 1.39 | B | 25.4 | 24.6 | 23.5 | 3.9 | 2.22 | 1.85 | 14.48 | 10.78 |
| Example 9 | 1.48 | 1.46 | 1.44 | A | 25.2 | 24.8 | 24.5 | 1.0 | 2.43 | 2.14 | 16.62 | 13.80 |
| Example 10 | 1.48 | 1.48 | 1.44 | A | 24.9 | 24.6 | 24.4 | 1.9 | 1.52 | 1.36 | 12.02 | 9.97 |
| Example 11 | 1.50 | 1.45 | 1.43 | B | 25.0 | 24.7 | 24.0 | 1.6 | 1.39 | 1.20 | 10.69 | 8.73 |
| Example 12 | 1.49 | 1.46 | 1.44 | A | 24.8 | 24.5 | 23.9 | 0.8 | 1.43 | 1.35 | 11.27 | 9.96 |
| Example 13 | 1.50 | 1.47 | 1.41 | B | 24.8 | 24.5 | 23.7 | 4.5 | 2.59 | 1.98 | 17.86 | 11.90 |
| Example 14 | 1.51 | 1.47 | 1.47 | A | 25.1 | 24.9 | 24.4 | 2.3 | 2.18 | 1.79 | 13.61 | 10.85 |
| Example 15 | 1.46 | 1.45 | 1.39 | C | 25.7 | 25.2 | 24.0 | 2.8 | 2.06 | 1.65 | 13.36 | 10.93 |
| Example 16 | 1.45 | 1.43 | 1.38 | B | 25.6 | 24.9 | 23.9 | 2.1 | 2.23 | 1.85 | 13.71 | 10.72 |
| Example 17 | 1.48 | 1.47 | 1.44 | A | 24.8 | 24.4 | 23.8 | 2.8 | 2.25 | 2.02 | 14.06 | 12.15 |
| Example 18 | 1.49 | 1.47 | 1.44 | A | 24.4 | 24.0 | 23.3 | 1.6 | 2.19 | 1.92 | 15.1 | 12.27 |
| Example 19 | 1.50 | 1.50 | 1.48 | A | 24.8 | 24.5 | 24.2 | 2.7 | 2.31 | 2.03 | 14.28 | 11.54 |
| Example 20 | 1.47 | 1.42 | 1.36 | C | 24.5 | 22.9 | 20.4 | 2.6 | 1.12 | 0.95 | 8.01 | 6.52 |
| Example 21 | 1.50 | 1.48 | 1.45 | B | 25.0 | 24.5 | 23.8 | 2.4 | 2.68 | 2.07 | 15.42 | 11.91 |
| Example 22 | 1.49 | 1.46 | 1.43 | A | 25.2 | 24.9 | 24.4 | 5.2 | 2.59 | 1.93 | 17.86 | 10.85 |
| Example 23 | 1.48 | 1.45 | 1.38 | B | 24.1 | 23.7 | 23.5 | 1.2 | 1.39 | 1.25 | 11.92 | 9.89 |
| Example 24 | 1.49 | 1.47 | 1.37 | C | 24.4 | 23.6 | 23.2 | 1.0 | 1.39 | 1.30 | 10.69 | 9.75 |
| Comparative | 1.35 | 1.12 | 0.79 | E | 23.8 | 19.2 | 12.2 | 8.6 | 0.78 | 0.40 | 5.42 | 3.21 |
| Comparative | 1.36 | 1.33 | 1.21 | E | 24.1 | 20.1 | 15.0 | 6.6 | 1.21 | 0.94 | 7.89 | 5.99 |
| Comparative | 1.44 | 1.40 | 1.25 | D | 24.8 | 22.6 | 18.9 | 8.4 | 2.26 | 1.29 | 16.74 | 8.89 |

TABLE 5-continued

H/H evaluation results

| | Image density | | | Resistance to contamination | M/S (dg/) | | | Abrasion level | Sleeve Ra | | Sleeve Rz | |
|---|---|---|---|---|---|---|---|---|---|---|---|---|
| | initial | 5000 sheets | 50000 sheets | 50000 sheets | Initial | 5000 sheets | 50000 sheets | 50000 sheets | Initial | 5000 sheets | Initial | 5000 sheets |
| Comparative | 1.35 | 1.02 | 0.59 | E | 23.5 | 15.5 | 10.8 | 10.5 | 0.78 | 0.42 | 5.42 | 3.14 |
| Comparative | 1.38 | 1.34 | 1.14 | E | 23.8 | 19.8 | 14.5 | 8.2 | 1.21 | 0.85 | 7.89 | 5.65 |
| Comparative | 1.45 | 1.42 | 1.34 | C | 24.4 | 22.2 | 19.9 | 5.0 | 1.12 | 0.90 | 8.01 | 6.32 |

What is claimed is:

1. A developing assembly comprising:

a developer container which holds therein a two-component developer comprising:

a magnetic carrier; and a non-magnetic toner; and a developer-carrying member by which said two-component developer held in said developer container is transported to a developing zone facing an electrostatic-latent-image-bearing member, to render visible a latent image formed on the latent-image-bearing member, wherein said magnetic carrier has a weight-average particle diameter of from 15 $\mu$m to 60 $\mu$m, wherein said developer-carrying member comprises at least;

a substrate; and a resin coat layer formed on the substrate surface, wherein said resin coat layer contains at least a binder resin and solid particles for forming an uneven resin coat layer surface having valleys and hills, wherein said solid particles have an average circularity of 0.64 or more, which is an average value of values calculated according to the following equation (1):

$$\text{Circularity}=(4\times A)/\{(ML)^2\times\Pi \quad (1),$$

for each solid particle, wherein ML represents the Pythagorean-method maximum length of a particle projected image of one of said solid particles, and A represents a projected area of a particle image of one of said solid particles, and said resin coat layer fulfilling the following condition:

$$S\geqq 3.0,$$

where, in a surface profile of the resin coat layer measured using a laser of a confocal optical system, the average value of heights from the bottoms of the valleys to the vertexes of the hills of the uneven resin coat layer surface in the whole measurement region is regarded as a standard height, and a proportion of surface area occupied by parts of hills more than 0.1×r higher than the standard height is represented by the percentage S, wherein r is the weight-average particle diameter, in units of $\mu$m, of said magnetic carrier; and wherein said resin coat layer further fulfills the following conditions:

$$Rp/Rv\geqq 1.2,\ Rz/Rv\geqq 2.0 \text{ and } r/Rp\leqq 6.0,$$

where the ten-point average roughness of said resin coat layer surface is represented by Rz, in units of $\mu$m, the average-line depth of said resin coat layer surface is represented by Rp, in units of $\mu$m, and the average-line height of said resin coat layer surface is represented by Rv, in units of $\mu$m.

2. The developing assembly according to claim 1, wherein the surface of said resin coat layer fulfills the following conditions:

$$S\geqq 5.0 \text{ and } r/Rp\leqq 5.0.$$

3. The developing assembly according to claim 1, wherein said resin coat layer contains a conductive agent therein providing said resin coat layer with conductivity.

4. The developing assembly according to claim 1, wherein said resin coat layer further contains a lubricating fine powder.

5. The developing assembly according to claim 1, wherein said resin coat layer further contains a charge-controllable material.

6. The developing assembly according to claim 1, wherein said solid particles have a number-average particle diameter of from 2 $\mu$m to 50 $\mu$m.

7. The developing assembly according to claim 1, wherein said solid particles are particles of an inorganic material selected from the group consisting of a metal oxide, a metal nitride, a metal carbide and a metal boride.

8. The developing assembly according to claim 1, wherein said solid particles are resin particles.

9. The developing assembly according to claim 1, wherein said solid particles are carbon particles.

10. The developing assembly according to claim 1, wherein said magnetic carrier is a solid magnetic carrier, and wherein said solid magnetic carrier is a magnetic-fine-particle-dispersed resin carrier comprising a binder resin having magnetic fine particles dispersed therein.

11. The developing assembly according to claim 1, which further comprises a developer layer thickness control member configured and positioned to form a layer of said two-component developer on said developer-carrying member on which said magnetic carrier particles are carried in an amount of 100 to 500 kg/m$^2$.

12. An image-forming apparatus comprising:

(i) an electrostatic-latent-image-bearing member configured to hold thereon an electrostatic latent image; and (ii) a developing assembly configured and positioned to develop the electrostatic latent image with a developer at a developing zone to form a developed image, said developing assembly comprising:

a developer container which holds therein a two-component developer comprised of a magnetic carrier having a weight-average particle diameter of from 15 $\mu$m to 60 $\mu$m and a non-magnetic toner; and a developer-carrying member, comprising at least;

a substrate; and a resin coat layer formed on the substrate surface and containing at least;

a binder resin; and solid particles for forming an uneven on the resin coat layer surface, wherein said solid particles have an average circularity of 0.64 or more, which is an average value of values calculated according to the following equation (1):

$$\text{Circularity}=(4\times A)/\{(ML)^2\times\Pi\} \quad (1)$$

for each solid particle, wherein ML represents the Pythagorean-method maximum length of a particle projected image of one of said solid particles, and A represents a projected area of a particle image of one of said solid particles, said resin coat layer fulfilling the following condition:

$$S\geqq 3.0$$

where, in a surface profile of the resin coat layer measured using a laser of a confocal optical system, the average value of heights from the bottoms of valleys to the vertexes of hills of the uneven resin coat layer surface in the whole measurement region is regarded as a standard height, and a proportion of surface area occupied by parts of hills more than 0.1×r higher than the standard height is represented by the percentage S, wherein r is the weight-average particle diameter, in units of μm, of said magnetic carrier; and wherein said resin coat layer further fulfills the following conditions:

$$Rp/Rv\geqq 1.2,\ Rz/Rv\geqq 2.0 \text{ and } r/Rp\leqq 6.0,$$

where the ten-point average roughness of the resin coat layer surface is represented by Rz in units of μm, the average-line depth of the resin coat layer surface is represented by Rv in units of μm.

13. The image-forming apparatus according to claim 12, wherein said electrostatic-latent-image-bearing member is an electrophotographic photosensitive member.

14. The image-forming apparatus according to claim 12, which further comprises transfer means for transferring a developed image onto a recording medium.

15. The image-forming apparatus according to claim 12, which further comprises fixing means for fixing the developed image onto a recording medium.

16. A process cartridge which is detachably mountable on the main body of an image-forming apparatus, said process cartridge integrally holding and comprising:

at least a developing assembly configured and positioned to develop an electrostatic latent image with a developer at a developing zone to form a developed image, said developing assembly comprising:

a developer container which holds therein a two-component developer comprised of a magnetic carrier having a weight-average particle diameter of from 15 μm to 60 μm and a non-magnetic toner; and a developer-carrying member, comprising at least:

a substrate; and a resin coat layer formed on the substrate surface, said resin coat layer containing at least;

a binder resin; and solid particles for forming an uneven resin coat layer surface, said solid particles having an average circularity of 0.64 or more, which is an average value of values calculated according to the following equation (1):

$$\text{Circularity}=(4\times A)/\{(ML)^2\times\Pi\} \quad (1)$$

for each solid particle, wherein ML represents the Pythagorean-method maximum length of a particle projected image of one of said solid particles; and A represents a projected area of a particle image of one of said solid particles; and said resin coat layer fulfilling the following condition:

$$S\geqq 3.0$$

where, in a surface profile of the resin coat layer measured using a laser of a confocal optical system, the average value of heights from the bottoms of valleys to the vertexes of hills of the uneven resin coat layer surface in the whole measurement region is regarded as a standard height, and a proportion of surface area occupied by parts of hills more than 0.1×r higher than the standard height is represented by the percentage S, wherein r is the weight-average particle diameter, in units of μm, of said magnetic carrier; and wherein said resin coat layer further fulfills the following conditions:

$$Rp/Rv\geqq 1.2,\ Rz/Rv\geqq 2.0 \text{ and } r/Rp\leqq 6.0$$

where the ten-point average roughness of the resin coat layer surface is represented by Rz, in units of μm, the average-line depth of the resin coat layer surface is represented by Rp, in units of μm, and the average-line height of the resin coat layer surface is represented by Rv, in units of μm.

17. The process cartridge according to claim 16, which further comprises an electrostatic-latent-image-bearing member configured and positioned to hold thereon the electrostatic latent image.

18. The process cartridge according to claim 17, wherein said electrostatic-latent-image-bearing member is an electrophotographic photosensitive member.

19. The process cartridge according to claim 16, which further comprises transfer means for transferring the developed image onto a recording medium.

20. The process cartridge according to claim 16, which further comprises fixing means for fixing the developed image onto a recording medium.

* * * * *

UNITED STATES PATENT AND TRADEMARK OFFICE

CERTIFICATE OF CORRECTION

PATENT NO. : 6,841,327 B2
DATED : January 11, 2005
INVENTOR(S) : Satoshi Otake et al.

It is certified that error appears in the above-identified patent and that said Letters Patent is hereby corrected as shown below:

Column 3,
Line 8, “sleeve)” should read -- sleeve). --.

Column 4,
Line 17, “ensures a” should read -- ensures --.
Line 34, “wherein” should read -- wherein, --.

Column 5,
Line 3, “-surfave” should read -- -surface --.
Line 12, “image,” should read -- image, wherein --.

Column 8,
Line 9, “Can” should read -- can --.
Line 14, “Ω·cm cm” should read -- Ω·cm --.

Column 10,
Line 17, “Xv” should read -- Rv --.
Line 23, “peripherals” should read -- peripheral --.
Line 65, “Model.” should read -- Model --.

Column 11,
Line 13, “oxides” should read -- oxides, --.
Line 35, “$10^2$ Ω·cm.” should read -- $10^{-2}$ Ω·cm. --.

Column 12,
Line 43, “be” should be deleted.

Column 14,
Line 1, “p-n-bexylstyelene,” should read -- p-n-hexylstyrene, --.
Line 8, “brominde” should read -- bromide --.
Line 21, “mothyl” should read -- methyl --.

Column 15,
Line 1, “filed” should read -- filled --.
Line 2, “particles” should read -- particles, --.
Line 26, “tanner” should read -- manner --.
Line 49, “such as,” should read -- such as a --.

Column 16,
Line 46, “means” should read -- means, --.
Line 50, “blond” should read -- blend --.

UNITED STATES PATENT AND TRADEMARK OFFICE

CERTIFICATE OF CORRECTION

PATENT NO. : 6,841,327 B2
DATED : January 11, 2005
INVENTOR(S) : Satoshi Otake et al.

It is certified that error appears in the above-identified patent and that said Letters Patent is hereby corrected as shown below:

Column 17,
Line 2, “develope-” should read -- developer --.
Line 56, “stated” should read -- a stated --.

Column 18,
Line 9, “having a” should read -- having --.
Line 47, “thereof” should read -- thereof, or --.

Column 19,
Line 45, “4c” should read -- 4e --.
Line 66, “5” should read -- 5, --.

Column 22,
Line 15, “methyl,” should read -- methyl --.
Line 24, “K-K.)” should read -- K.K.) --.
Line 26, “1 had” should read -- had --.

Column 23,
Line 3, “(negative-charging” should read -- (positive-charging --.

Column 24,
Line 4, “CP2150” should read -- CP2100 --.
Line 32, “Prom” should read -- From --.

Column 26,
Line 10, “A-d” should read -- A-4 --.
Line 67, “A-B” should read -- A-8 --.

Column 31,
Table 2, Line 4, “Ru” should read -- Ra --.

Columns 33 and 34,
Tables 4 and 5, in the Image Density column, “initial” should read -- Initial --.
Table 4, in the Image Density column, in the 50000 sheets subcolumn, and in the Example 12 row, “1.52” should read -- 1.51 --.
Table 4, in the M/S column, in the 5000 sheets subcolumn, and in the Example 7 row, “74.5” should read -- 24.5 --.
Table 4, in the Sleeve Ra column, in the 50000 sheets subcolumn, and in the Example 15 row, “2.86” should read -- 1.86 --.
Table 5, in the Image Density column, “initial” should read -- Initial --
Table 5, in the Image Density column, in the 50000 sheets subcolumn, and in the Example 7 row, “3.39” should read -- 1.39 --.

UNITED STATES PATENT AND TRADEMARK OFFICE

CERTIFICATE OF CORRECTION

PATENT NO. : 6,841,327 B2
DATED : January 11, 2005
INVENTOR(S) : Satoshi Otake et al.

It is certified that error appears in the above-identified patent and that said Letters Patent is hereby corrected as shown below:

Columns 33 and 34 (cont'd),
Table 5, in the Sleeve Rz column, "5000" should read -- 50000 --.
Table 5, in the Sleeve Rz column, "5000" should read -- 50000 --.

Columns 35 and 36,
TABLE 5-CONTINUED
Under the column Sleeve Ra, "5000" should read -- 50000 --.
Under the column Sleeve Rz, "5000" should read -- 50000 --.
Under the column Image Density, "initial" should read -- Initial --.

Column 35,
Line 30, "at least;" should read -- at least: --.
Line 41, "$(4 \times A)/\{(ML)^2 \times II$" should read -- $(4 \times A)/\{(ML)^2 \times II\}$ --.

Column 36,
Line 66, "at least;" should read -- at least: --.

Column 37,
Line 2, "at least;" should read -- at least: --.
Line 4, "on the" should be deleted.
Line 39, "Rv" should read -- Rp --.
Line 40, after "$\mu$m" insert -- and the average-line height of the resin coat layer surface is represented by Rv in units of $\mu$m --.

Column 38,
Line 4, "at least;" should read -- at least: --.
Line 14, "particles;" should read -- particles, --.

Signed and Sealed this

Twenty-first Day of February, 2006

JON W. DUDAS
*Director of the United States Patent and Trademark Office*